US006980169B2

(12) United States Patent
Honda

(10) Patent No.: US 6,980,169 B2
(45) Date of Patent: Dec. 27, 2005

(54) ELECTROMAGNETIC LENS

(75) Inventor: Royden M. Honda, Post Falls, ID (US)

(73) Assignee: Vivato, Inc., San Francisco, CA (US)

( * ) Notice: Subject to any disclaimer, the term of this patent is extended or adjusted under 35 U.S.C. 154(b) by 133 days.

(21) Appl. No.: 10/760,023

(22) Filed: Jan. 16, 2004

(65) Prior Publication Data

US 2005/0156801 A1 Jul. 21, 2005

(51) Int. Cl.[7] ..... H01Q 13/00

(52) U.S. Cl. ..... 343/775; 343/780; 343/911 R

(58) Field of Search ..... 343/772, 775, 343/780, 785, 909, 911 R

(56) References Cited

U.S. PATENT DOCUMENTS

2004/0174299 A1* 9/2004 Casas et al. ..... 342/373
2004/0223476 A1* 11/2004 Jose et al. ..... 370/338
2004/0224637 A1* 11/2004 Silva et al. ..... 455/63.4
2005/0075070 A1* 4/2005 Crilly, Jr. ..... 455/13.3

OTHER PUBLICATIONS

Y.T. Lo & S.W. Lee, Antenna Handbook, vol. II, Van Nostrand Reinhold, New York, 1993, pp. 15-51 to 15-61, ibid pp. 19-19 to 19-23.

Walter Rotman, "Wide Angle Scanning with Microwave Double-Layer Pillboxes", IRE Transactions on Antennas and Propagation, vol. 6, pp. 96-105; Jan., 1958.

* cited by examiner

*Primary Examiner*—Shih-Chao Chen
(74) *Attorney, Agent, or Firm*—Lee & Hayes, PLLC

(57) ABSTRACT

In an exemplary apparatus implementation, an electromagnetic lens includes: an input section including multiple input probes and a curvilinear input reflector; an output section including multiple output probes and a curvilinear output reflector; and a coupling section including a coupling slot and a curvilinear coupling wall. In another exemplary apparatus implementation, an electromagnetic lens includes: a first layer; a second layer adjacent to the first layer; the second layer including multiple input probes, a curvilinear input reflector, and a first curvilinear coupling wall; a third layer adjacent to the second layer, the third layer including a coupling slot; a fourth layer adjacent to the third layer; the fourth layer including multiple output probes, a curvilinear output reflector, and a second curvilinear coupling wall; and a fifth layer adjacent to the fourth layer.

85 Claims, 13 Drawing Sheets

402(1)
402(2)
402(3)
402(I)
ELECTRO-MAGNETIC LENS 210
TOP VIEW

LAYERS
1ST
2ND
3RD
4TH
5TH
FROM SIGNAL PROCESSOR(S)
TO ANTENNA ARRAY
402(i)
404(o)
412
416
406
INPUT SECTION
410
OUTPUT SECTION
414I
414O
210
TOP
BOTTOM
408
COUPLING SECTION
SECTIONAL VIEW

ELECTROMAGNETIC LENS

TECHNICAL FIELD

This disclosure relates in general to electromagnetic beamforming and in particular, by way of example but not limitation, to a folded parallel plate waveguide lens for electromagnetic beamforming.

BACKGROUND

So-called local area networks (LANs) have been proliferating to facilitate communication since the 1970s. Certain LANs (e.g., those operating in accordance with IEEE 802.3) have provided enhanced electronic communication through wired media for decades. Since the late 1990s, LANs have expanded into wireless media so that networks may be established without necessitating wire connections between or among various network elements. Such LANs may operate in accordance with IEEE 802.11 (e.g., 802.11(a), (b), (e), (g), etc.) or other wireless network standards.

Although standard LAN protocols, such as Ethernet, may operate at fairly high speeds with inexpensive connection hardware and may bring digital networking to almost any computer, wireless LANs can often achieve the same results more quickly, more easily, and/or at a lower cost. Furthermore, wireless LANs provide increased mobility, flexibility, and spontaneity when setting up a network for two or more devices.

In wireless communication (including wireless LANs), signals are sent from a transmitter to a receiver using electromagnetic waves that emanate from an antenna. These electromagnetic waves may be sent equally in all directions or focused in one or more desired directions. When the electromagnetic waves are focused in a desired direction, the pattern formed by the electromagnetic wave is termed a "beam" or "beam pattern." Hence, the production and/or application of such electromagnetic beams are typically referred to as "beamforming."

Beamforming may provide a number of benefits such as greater range and/or coverage per unit of transmitted power, improved resistance to interference, increased immunity to the deleterious effects of multipath transmission signals, and so forth. Beamforming can be achieved through a number of different approaches, including (i) using a finely tuned vector modulator to drive each antenna element to thereby arbitrarily form beam shapes, (ii) by implementing full adaptive beam forming, (iii) by connecting a transmit/receive signal processor to each port of a Butler matrix, and (iv) by connecting at least one transmit/receive signal processor to an electromagnetic lens.

Unfortunately, beamforming is typically constrained by the apparatus and schemes used to achieve it. For example, approaches (i) and (ii) are complex, costly, and/or power intensive. Approach (iii) has limited flexibility, and approach (iv) can be bulky and/or can introduce non-linearity into the electromagnetic signals. Other additional factors can adversely impact the applicability and usability of beamforming in wireless communication systems.

Accordingly, there is a need for apparatuses and/or schemes for improving the viability and versatility of wireless communication and beamforming options therefor.

SUMMARY

In an exemplary apparatus implementation, an electromagnetic lens includes: an input section including multiple input probes and a curvilinear input reflector; an output section including multiple output probes and a curvilinear output reflector; and a coupling section including a coupling slot and a curvilinear coupling wall.

In another exemplary apparatus implementation, an electromagnetic lens includes: a first layer; a second layer adjacent to the first layer; the second layer including multiple input probes, a curvilinear input reflector, and a first curvilinear coupling wall; a third layer adjacent to the second layer, the third layer including a coupling slot; a fourth layer adjacent to the third layer; the fourth layer including multiple output probes, a curvilinear output reflector, and a second curvilinear coupling wall; and a fifth layer adjacent to the fourth layer.

Other method, system, apparatus (including electromagnetic lenses, access stations, etc.), media, arrangement, etc. implementations are described herein.

BRIEF DESCRIPTION OF THE DRAWINGS

The same numbers are used throughout the drawings to reference like and/or corresponding aspects, features, and components.

DETAILED DESCRIPTION

Figure 1:
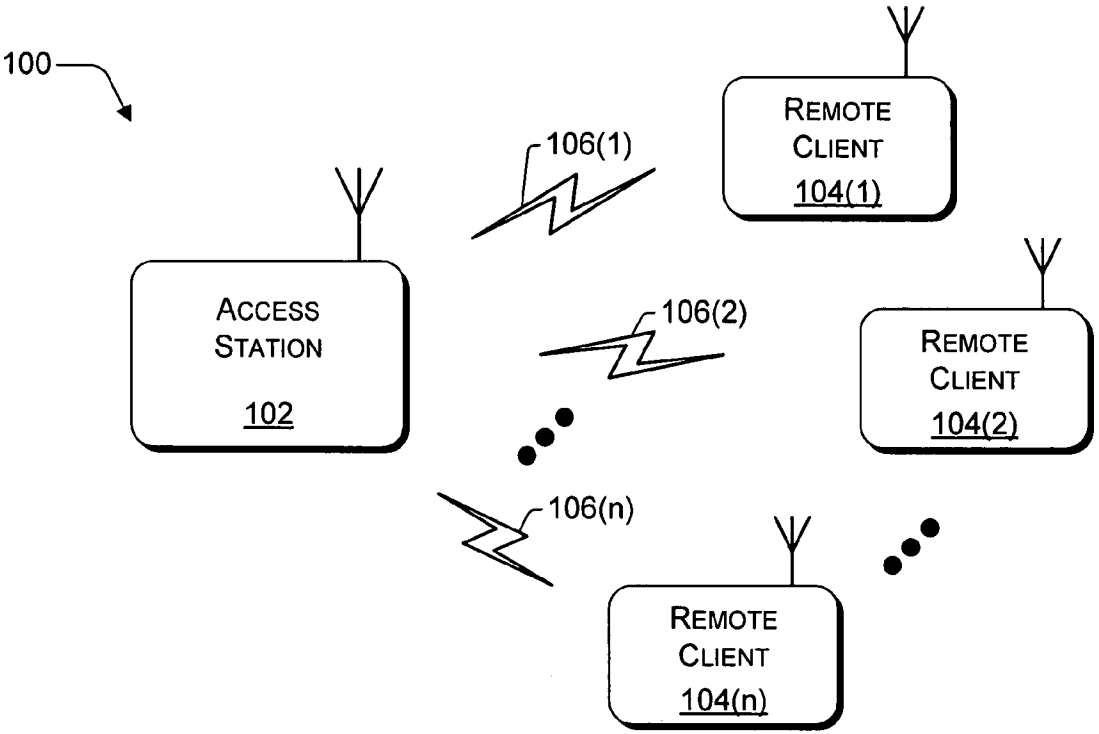
FIG. 1 is an exemplary general wireless communications environment that includes an access station, multiple remote clients, and multiple communication links.

FIG. 1 is an exemplary general wireless communications environment 100 that includes an access station 102, multiple remote clients 104, and multiple communication links 106. Wireless communications environment 100 is representative generally of many different types of wireless communications environments, including but not limited to those pertaining to wireless local area networks (LANs) or wide area networks (WANs) (e.g., Wi-Fi) technology, cellular technology (including so-called personal communication services (PCS)), trunking technology, and so forth.

In wireless communications environment 100, access station 102 is in wireless communication with remote clients 104(1), 104(2) . . . 104(n) via wireless communications or communication links 106(1), 106(2) . . . 106(n), respectively. Although not required, access station 102 is typically fixed, and remote clients 104 are typically mobile. Also, although three remote clients 104(1, 2 . . . n) are shown, access station 102 may be in wireless communication with many such remote clients 104.

With respect to a so-called Wi-Fi wireless communications system, for example, access station 102 and/or remote clients 104 may operate in accordance with any IEEE 802.11 or similar standard. With respect to a cellular system, for example, access station 102 and/or remote clients 104 may operate in accordance with any analog or digital standard, including but not limited to those using time division/demand multiple access (TDMA), code division multiple access (CDMA), spread spectrum, some combination thereof, or any other such technology.

Access station 102 may be, for example, a nexus point, a trunking radio, a base station, a Wi-Fi switch, an access point, some combination and/or derivative thereof, and so forth. Remote clients 104 may be, for example, a hand-held device, a desktop or laptop computer, an expansion card or similar that is coupled to a desktop or laptop computer, a personal digital assistant (PDA), a mobile phone, a vehicle having a wireless communication device, a tablet or hand/palm-sized computer, a portable inventory-related scanning device, any device capable of processing generally, some combination thereof, and so forth. Remote clients 104 may operate in accordance with any standardized and/or specialized technology that is compatible with the operation of access station 102.

Figure 2:
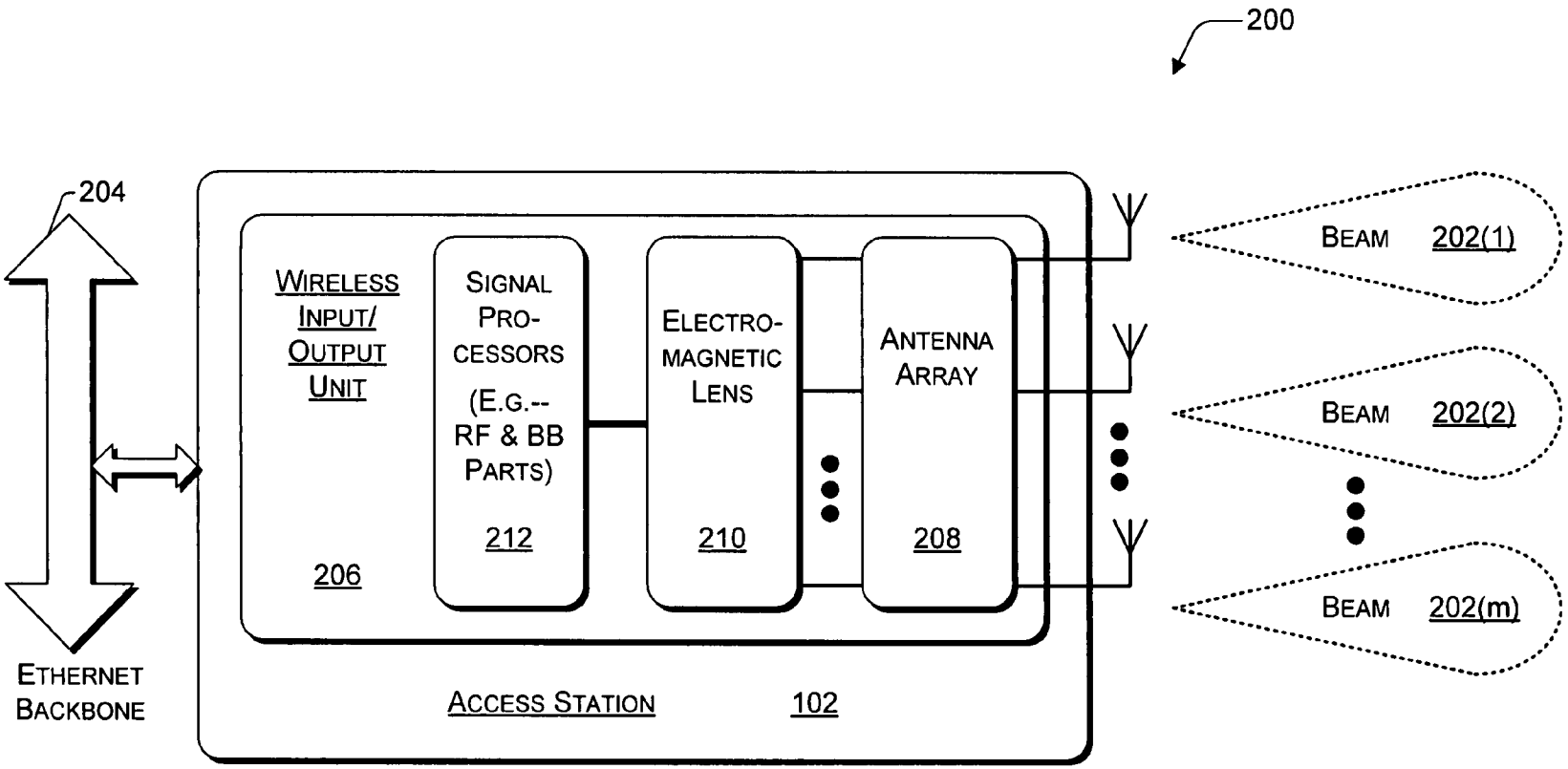
FIG. 2 is an exemplary wireless LAN/WAN communications environment that includes an access station, a wireless input/output (I/O) unit having an electromagnetic lens, and multiple communication beams.

FIG. 2 is an exemplary wireless LAN/WAN communications environment 200 that includes an access station 102, a wireless input/output (I/O) unit 206 having an electromagnetic lens 210, and multiple communication beams 202. Wireless LAN/WAN communications environment 200 may comport with, for example, a Wi-Fi-compatible or similar standard. Thus, in such an implementation, exemplary access station 102 may operate in accordance with a Wi-Fi-compatible or similar standard. Access station 102 is coupled to an Ethernet backbone 204. Access station 102 (of FIG. 2) may be considered a Wi-Fi switch, especially because it is illustrated as being directly coupled to Ethernet backbone 204 without an intervening external Ethernet router or switch.

In a described implementation, access station 102 includes wireless I/O unit 206. Wireless I/O unit 206 includes an antenna array 208, electromagnetic lens 210, and one or more signal processors 212. Signal processors 212 are capable of facilitating transmission and/or reception and may include radio frequency (RF) and/or base band (BB) parts (not separately shown) that interface (e.g., via processor interface(s)) with electromagnetic lens 210. For example, multiple BB parts may be connected to respective multiple RF parts with the RF parts being coupled (directly or indirectly) to electromagnetic lens 210. Electromagnetic lens 210 comprises a beamformer and is described further herein below. In addition to signal processors 212, electromagnetic lens 210 is coupled to antenna array 208.

From a transmission perspective, input nodes or probes (not explicitly shown in FIG. 2) of electromagnetic lens 210 are coupled to signal processors 212, and output nodes or probes of electromagnetic lens 210 are coupled to antenna array 208. From a reception perspective, output nodes or probes of electromagnetic lens 210 are coupled to signal processors 212, and input nodes or probes of electromagnetic lens 210 are coupled to antenna array 208. Generally, processor or beam nodes/probes of electromagnetic lens 210 are coupled to signal processors 212, and antenna nodes/probes of electromagnetic lens 210 are coupled to antenna array 208.

Antenna array 208 is implemented as two or more antennas or antenna elements, and optionally as a phased array of antennas and/or as a so-called smart antenna. Wireless I/O unit 206 is capable of transmitting and/or receiving (i.e., transceiving) signals (e.g., wireless communication(s) 106 (of FIG. 1)) via antenna array 208. These wireless communication(s) 106 are transmitted to and received from (i.e., transceived with respect to) a remote client 104 (also of FIG. 1). These signals may be transceived directionally with respect to one or more particular communication beams 202.

In wireless communication, signals may be sent from a transmitter to a receiver using electromagnetic waves that emanate from one or more antennas as focused in one or more desired directions, which contrasts with omni-directional transmission. This focusing of the electromagnetic waves in a desired direction and over a desired sector or other spatial area results in one or more beams or beam patterns, such as communication beams 202.

The production, usage, and/or application of such electromagnetic beams is typically referred to as beamforming. Beamforming usually entails employing at least one of any of a number of active and passive beamformers, such as electromagnetic lens 210. General examples of such active and passive beamformers include a tuned vector modulator (multiplier), a Butler matrix, a Rotman or other lens, a canonical beamformer, a lumped-element beamformer is with static or variable inductors and capacitors, and so forth. Also, beams may generally be formed using full adaptive beamforming.

In a described implementation, an employed beamformer comprises electromagnetic lens 210. By using electromagnetic lens 210 along with antenna array 208, multiple communication beams 202(1), 202(2) . . . 202(m) may be produced by wireless I/O unit 206. Although three beams 202(1, 2, m) are illustrated with three antennas of antenna array 208, it should be understood that the multiple antennas of antenna array 208 work in conjunction with each other to produce the multiple beams 202(1, 2 . . . m), where "m" generally corresponds to the number of processor or beam ports on electromagnetic lens 210. An exemplary set of communication beam patterns is described below with reference to FIG. 3.

Figure 3:
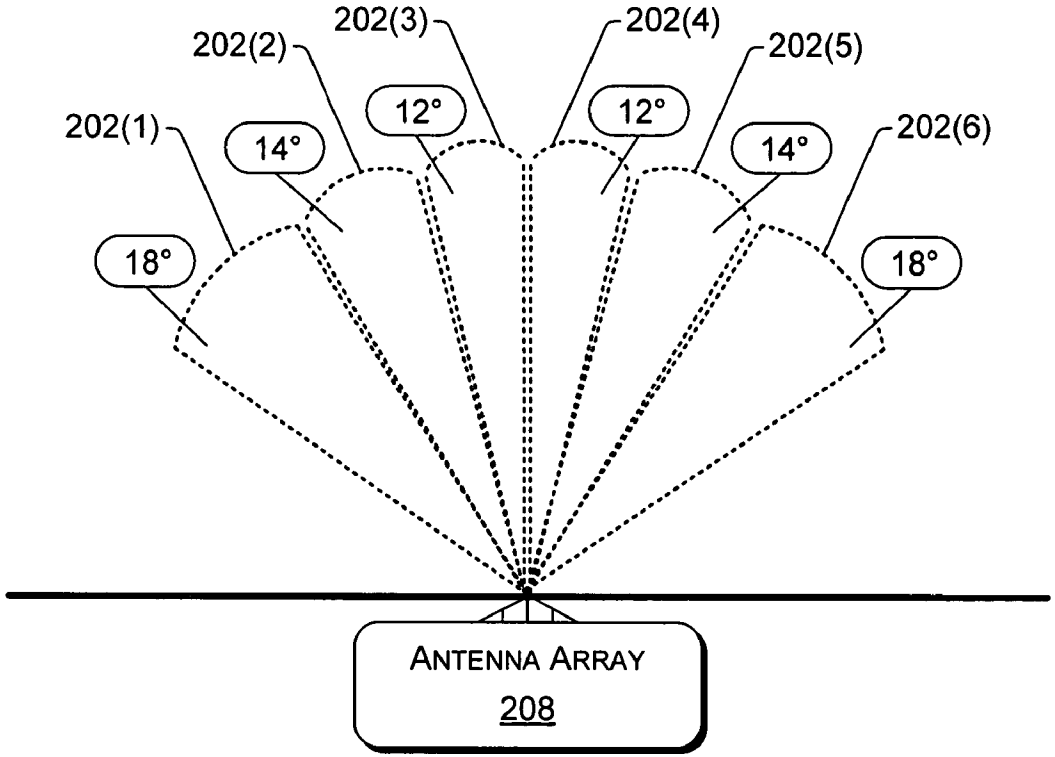
FIG. 3 illustrates an exemplary set of communication beams that emanate from an antenna array of an access station as shown in FIG. 2.

FIG. 3 illustrates an exemplary set of communication beams 202 that emanate from an antenna array 208 of an access station 102 as shown in FIG. 2. In a described implementation, antenna array 208 includes eight antenna elements 208(1, 2 . . . 7, and 8) (not explicitly shown). From the eight antennas 208(1 . . . 8), six different communication beams 202(1), 202(2) . . . 202(5), and 202(6) may be formed as the wireless signals emanating from antenna elements 208 add and subtract from each other during electromagnetic propagation.

Communication beams 202(1) . . . 202(6) spread out over a 90° arc. The narrowest two beams are communication beams 202(3) and 202(4), and the beams become wider as they spread symmetrically outward from a central axis. For example, beam 202(5) is wider than beam 202(4), and beam 202(6) is wider still than beam 202(5). In a specific exemplary implementation, beams 202(3) and 202(4) are approximately 12° wide (e.g., at the half-power beamwidth), beams 202(2) and 202(5) are approximately 14° wide, and beams 202(1) and 202(6) are approximately 18° wide.

The increasing widths of the beams 202(3-2-1) and 202 (4-5-6) as they spread outward from the central axis are due to real-world effects of the interactions between and among the wireless signals as they emanate from antenna array 208 (e.g., assuming a linear antenna array in a described implementation). It should be understood that the set of communication beam patterns illustrated in FIG. 3 are exemplary only and that other communication beam pattern sets may differ in width, shape, number, angular coverage, and so forth. For example, in an alternative implementation, thirteen communication beams 202 (e.g., beams 202(0 . . . 6) and beams 202(10 . . . 15)) of sixteen communication beams 202(0 . . . 15) emanating from an antenna array 208 that has sixteen antenna elements may be utilized.

Figures 4A, 4B:
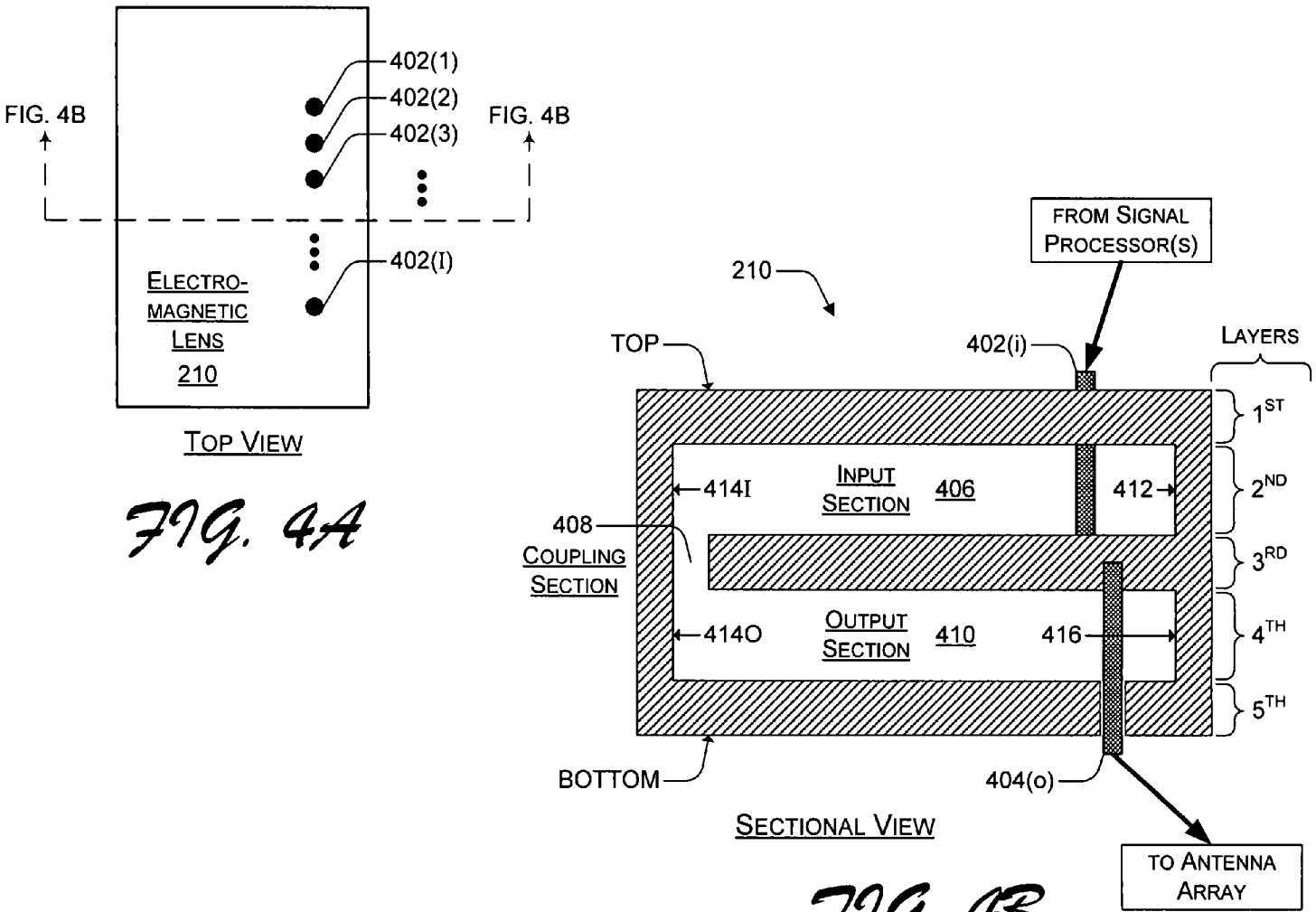
FIG. 4A illustrates a top view of an exemplary electromagnetic lens as shown in FIG. 2.
FIG. 4B illustrates a sectional view of an exemplary electromagnetic lens as shown in FIGS. 2 and 4A.

FIG. 4A illustrates a top view of an exemplary electromagnetic lens 210 as shown in FIG. 2. The top view of electromagnetic lens 210 is shown as being rectangular. However, the external configuration may be implemented as any convenient shape, such as a shape that fits within and/or complements the physical constraints of an intended access station 102 in which electromagnetic lens 210 is to be employed. Additionally, it should be noted that the accompanying FIGS. 1–13 that are described herein are not necessarily drawn to scale.

The top view of electromagnetic lens 210 includes access to at least one input probe 402. Specifically, "I" input probes 402 are illustrated as input probes 402(1), 402(2), 402(3) . . . 402(I). Although not explicitly illustrated in FIG. 4A, electromagnetic lens 210 includes "O" output probes 404. These output probes 404 may be accessible, for example, on a different side of electromagnetic lens 210 from that of input probes 402. An output probe 404 is illustrated in FIG. 4B. As indicated by the dashed arrow lines in FIG. 4A, FIG. 4B represents an exemplary cross-sectional view of electromagnetic lens 210.

FIG. 4B illustrates a sectional view of exemplary electromagnetic lens 210 as shown in FIGS. 2 and 4A. Electromagnetic lens 210 is illustrated as a folded parallel plate waveguide lens. Electromagnetic lens 210 includes five layers: a first layer, a second layer, a third layer, a fourth layer, and a fifth layer. As shown, the first layer presents the top of electromagnetic lens 210, and the fifth layer presents the bottom of electromagnetic lens 210. It should be noted that "top" and "bottom" are for clarifying descriptive purposes only and that any side may be oriented toward an arbitrary "top". Furthermore, although the five layers are shown as being integrated and/or contiguous, one or more layers may alternatively be realized from discrete and/or separate materials.

The sectional view of exemplary electromagnetic lens 210 shows an input probe 402(i) and an output probe 404(o). Input probes 402 are coupled (directly or indirectly) to one or more signal processors, such as signal processors 212 (of FIG. 2). Output probes 404 are coupled (directly or indirectly) to antenna array 208. For example, input/output probes 402/404 may be coupled to signal processors 212/ antenna array 208 with no connectors, with standard RF connectors, with cabling, via another device, some combination thereof, and so forth. Input/output probes 402/404 may be realized as, for example, studs (e.g., PEM® brand self-clinching studs), and electromagnetic lens 210 may be constructed from one or more metals, such as aluminum. An alternative to studs are stand-offs pressed into the third layer and machine screws that are screwed into the stand-offs to become input/output probes 402/404. Other alternatives may also be used.

In the particular cross-section of electromagnetic lens 210 in FIG. 4B, output probe 404(o) is shown in cross section while input probe 402(i) is shown with its exterior side. Hence, input probes 402 and output probes 404 may not be co-located from a depth perspective. Similarly, input probes 402 and output probes 404 may or may not be co-located from a transverse perspective. As indicated by the illustration of output probe 404(o), input/output probes 402/404 may be embedded in the third layer and insulated from the first and fifth layers. In an alternative implementation, the third, fourth, and fifth layers can be extended outward beyond the first and second layers and output probes 404 embedded into the fifth layer and insulated from the third layer so as to locate output probes 404 on the same side as input probes 402.

In a described implementation, electromagnetic lens 210 includes an input section 406, a coupling section 408, and an output section 410. Input section 406 is formed from an input plate of the first layer and a common plate of the third layer, and it includes an input reflector 412 of the second layer. Output section 410 is formed from an output plate of the fifth layer and the common plate of the third layer, and it includes an output reflector 416 of the fourth layer. Coupling section 408 is formed from the common plate of the third layer, and it includes at least one coupling wall 414. As shown, coupling section 408 includes an input coupling wall 414I of the second layer and an output coupling wall 414O of the fourth layer.

In operation, an electromagnetic signal is provided at input probe 402(i) from a signal processor 212. The electromagnetic signal or wave emanates from input probe 402(i) and is guided along input section 406 using two parallel plates (i.e., the input plate and the common plate of the first and third layers, respectively) in conjunction with input reflector 412. When the electromagnetic wave reaches coupling section 408 from input section 406, it is redirected through a slot (e.g., that is formed from the common plate of the third layer) to output section 410 via input and output coupling walls 414I and 414O. The electromagnetic wave is guided along output section 410 using two parallel plates (i.e., the common plate and the output plate of the third and fifth layers, respectively) in conjunction with output reflector 416. Output probe 404(o), along with other output probes 404, receives the electromagnetic wave and forwards it to antenna array 208.

The (i) locations of input/output probes 402/404 and/or the (ii) shapes and locations of reflectors 412 and 416 and of coupling wall 414 are configured so as to modify the phase of the electromagnetic wave as it propagates through electromagnetic lens 210. Moreover, electromagnetic lens 210 is adapted to shift the phase of the electromagnetic wave as it impacts output probes 404 as compared to the phase of the electromagnetic wave as it is launched from input probe(s) 402.

The phase shifting is accomplished while establishing (including maintaining) a linear phase front of the electromagnetic wave as it reaches output probes 404. Although shown using an air medium for electromagnetic signal propagation, electromagnetic lens 210 may alternatively include one or more dielectric materials. For example, input section 406 and/or output section 410 (and possibly coupling section 408) may be fully or partially implemented as and/or filled with a dielectric material. With a dielectric material, the overall size of electromagnetic lens 210 may be reduced, but the insertion loss concomitantly increases.

Reflectors 412 and 416 and coupling wall 414 may each be shaped as curvilinear sections, which may be convex or concave when curved. Curvilinear sections as described herein may be extrapolated curves (including those having multiple foci), linear sections, non-circular conics, and so forth. Non-circular conic sections include parabolic sections, hyperbolic sections, elliptical sections, and so forth. Specific exemplary curvilinear section implementations for reflectors 412, 414, and 416 are described further below.

Figure 5:
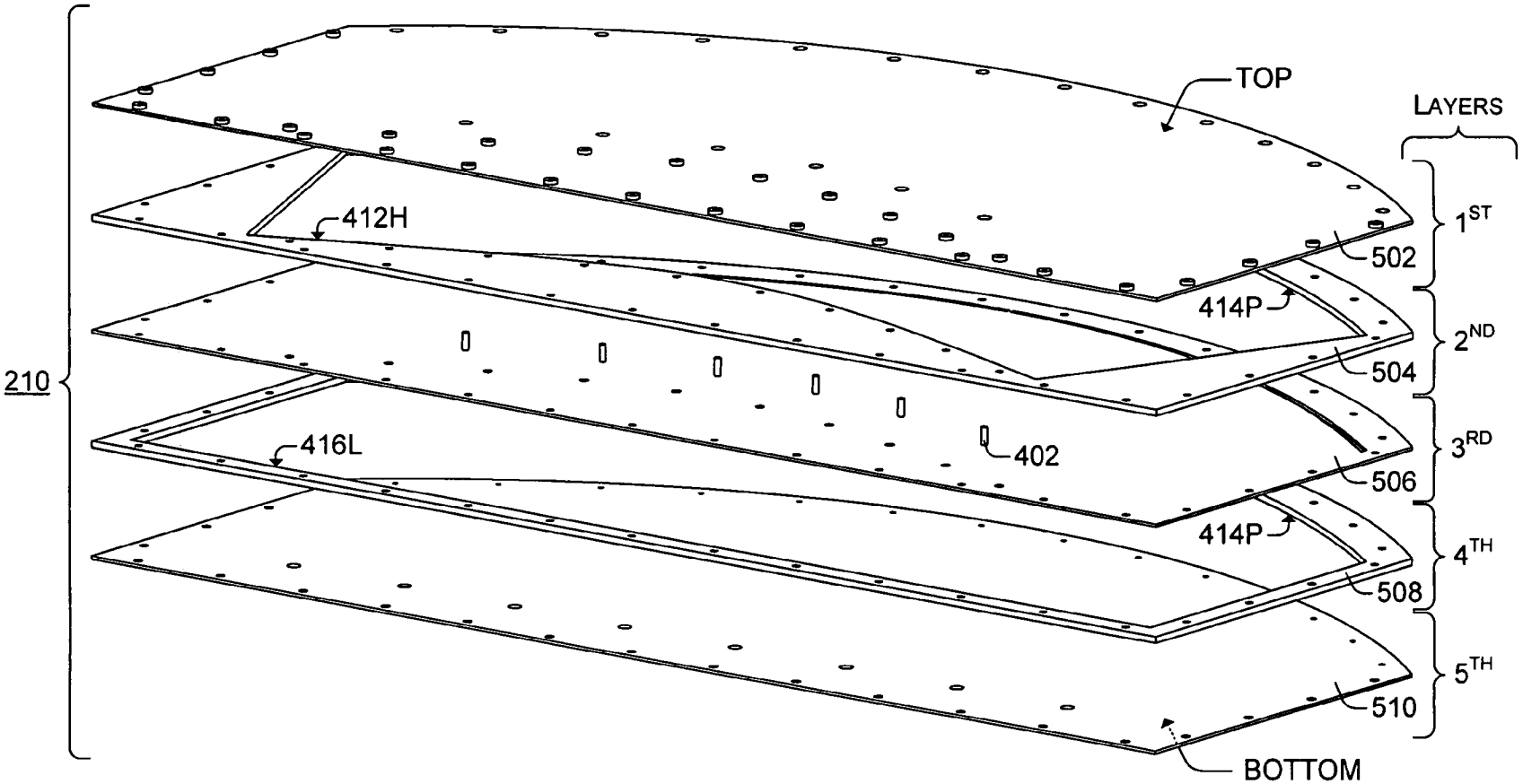
FIG. 5 is a three-dimensional exploded view of an exemplary implementation of an electromagnetic lens that illustrates first, second, third, fourth, and fifth layers thereof.

FIG. 5 is a three-dimensional exploded view of an exemplary implementation of an electromagnetic lens 210 that illustrates first, second, third, fourth, and fifth layers thereof. The relative top and bottom of electromagnetic lens 210 are indicated for perspective and comparison to FIGS. 4A, 4B, and 6–8. The first layer comprises an input plate 502, the third layer comprises a common plate 506, and the fifth layer comprises an output plate 510. The second layer comprises an input spacer 504, and the fourth layer comprises an output spacer 508.

Figure 8:
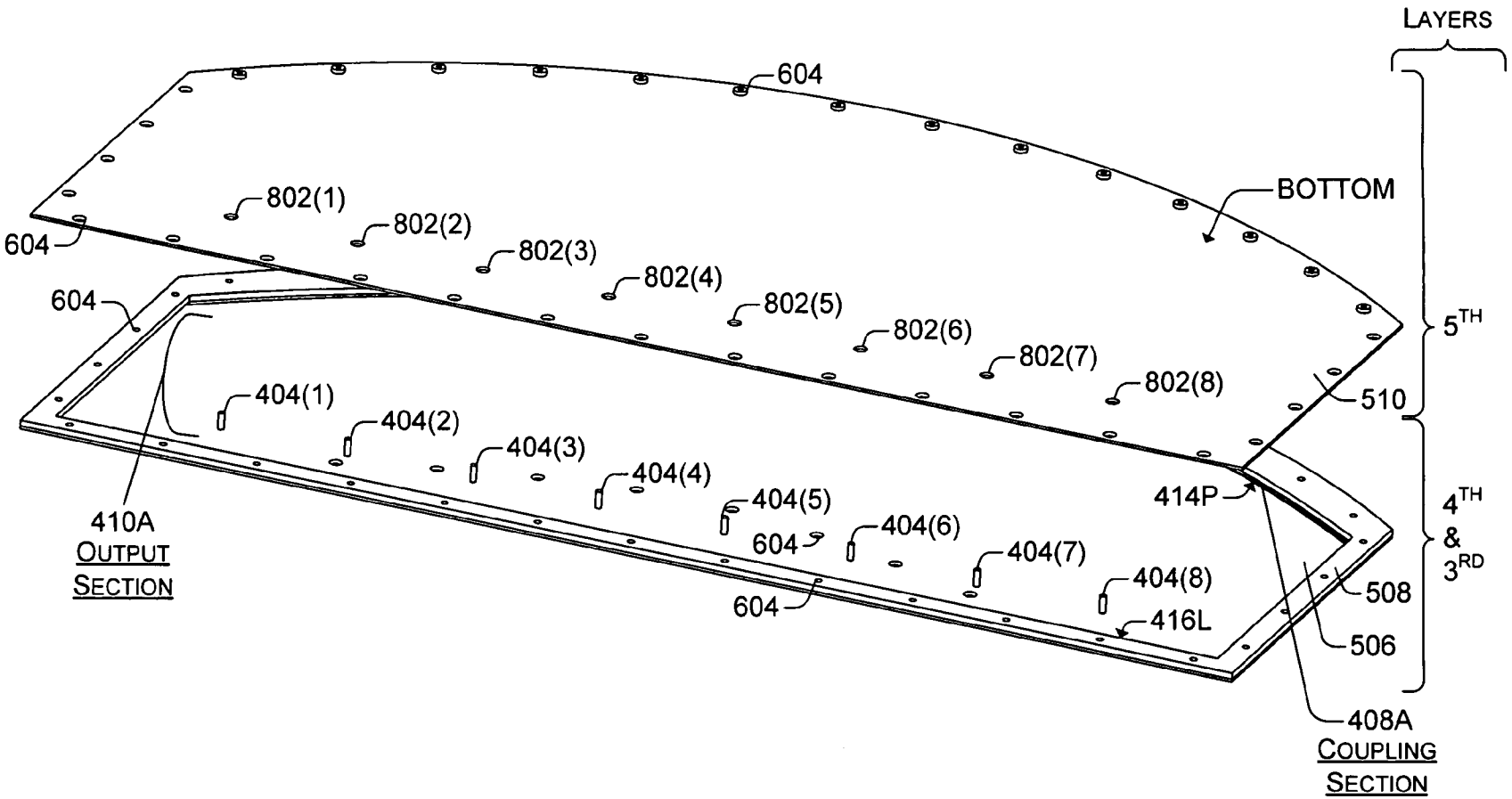
FIG. 8 is a partial exploded view of the exemplary implementation of the electromagnetic lens of FIG. 5 that illustrates the third, fourth, and fifth layers thereof.

In this exemplary implementation, input probes 402 are secured to common plate 506. Although not visible in FIG. 5, output probes 404 are secured to the "underside" of common plate 506. These output probes 404 are illustrated in FIG. 8.

As illustrated, input reflector 412H is hyperbolic in shape, coupling wall 414P is parabolic in shape, and output reflector 416L is linear in shape. Specifically, input reflector 412H and (first or input) coupling wall 414P are formed from and/or established by input spacer 504, and output reflector 416L and (second or output) coupling wall 414P are formed from and/or established by output spacer 508.

In a described implementation, input plate 502, common plate 506, and output plate 510 are fabricated from 0.050-inch aluminum sheet stock. Input spacer 504 and output spacer 508 are fabricated from 0.125-inch aluminum sheet stock. As a general guideline, plates 502, 506, and 510 are sufficiently thick so as to prevent or at least limit penetration by an electromagnetic wave propagating therebetween. Spacers 504 and 508, on the other hand, are sufficiently thin (e.g., less than or equal to half the wavelength of the electromagnetic wave ($\lambda/2$)) so as to provide a waveguide that supports a transverse electromagnetic (TEM) mode of propagation.

Figure 6:
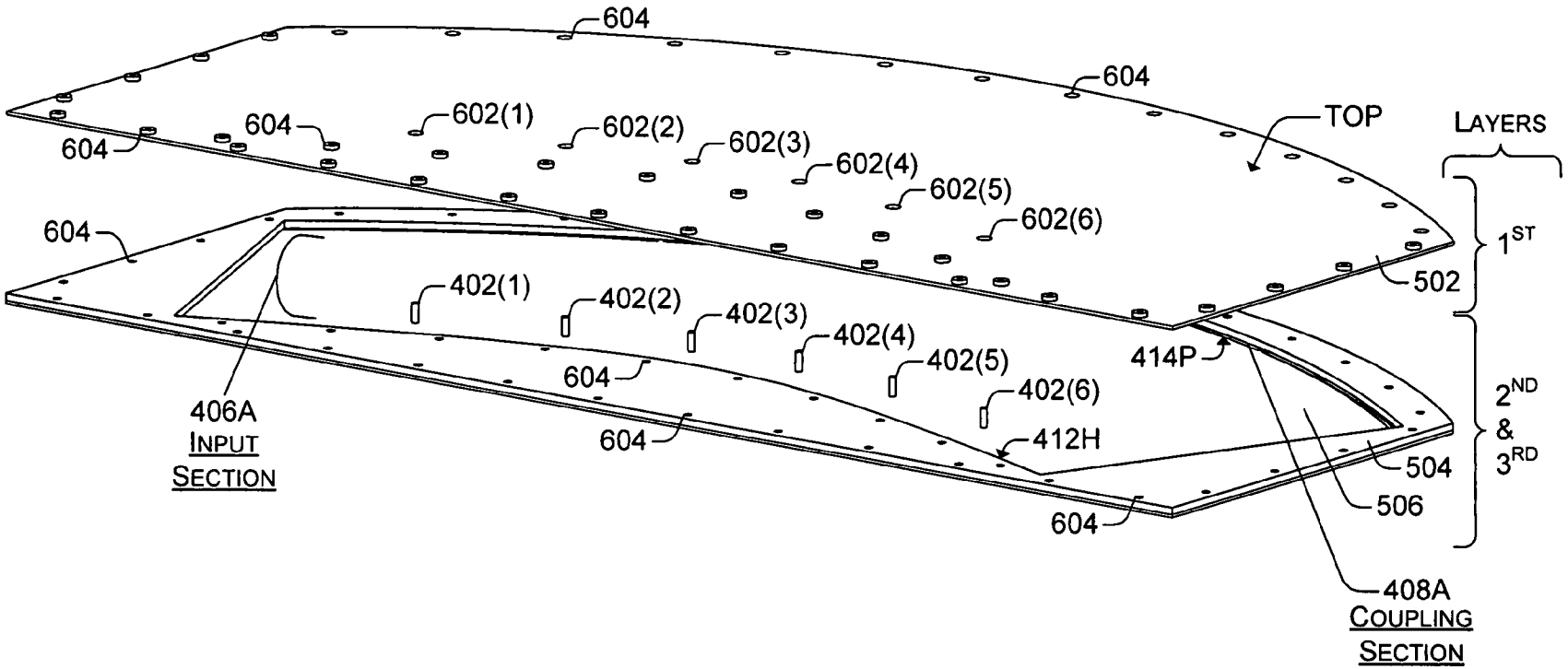
FIG. 6 is a partial exploded view of the exemplary implementation of the electromagnetic lens of FIG. 5 that illustrates the first, second, and third layers thereof.

FIG. 6 is a partial exploded view of the exemplary implementation of the electromagnetic lens 210 of FIG. 5 that illustrates the first, second, and third layers thereof. Input spacer 504 of the second layer and common plate 506 of the third layer are shown in contact with each other. Input plate 502 of the first layer is shown separated from input spacer 504 (and common plate 506) to reveal input section 406A and coupling section 408A. The parabolic shape of (input) coupling wall 414P and the hyperbolic shape of input reflector 412H are visible, too.

In a described implementation, six input probes 402(1), 402(2), 402(3), 402(4), 402(5), and 402(6) are utilized. These six input probes 402(1 . . . 6) correspond to six communication beams 202(1 . . . 6) as established via antenna array 208, and they are coupled to between one and six different signal processors 212 (depending on the configuration/capabilities of signal processor(s) 212). To couple the six input probes 402(1 . . . 6) to signal processor(s) 212, the six input probes 402(1 . . . 6) are exposed through six orifices 602(1), 602(2), 602(3), 602(4), 602(5), and 602(6), respectively. To avoid electromagnetic signal interaction, the six input probes 402(1 . . . 6) are insulated from input plate 502 (e.g., with air or another non-conductor).

Input plate 502, input spacer 504, and common plate 506 (see FIG. 7) are shown with a multitude of holes, many of which are specifically indicated as holes 604. The holes are used to fasten at least input plate 502, input spacer 504, and common plate 506 together using rivets, screws, bolts, and so forth. However, alternative fastening mechanism(s) may be used to fasten input plate 502, input spacer 504, and common plate 506 together.

Figure 7:
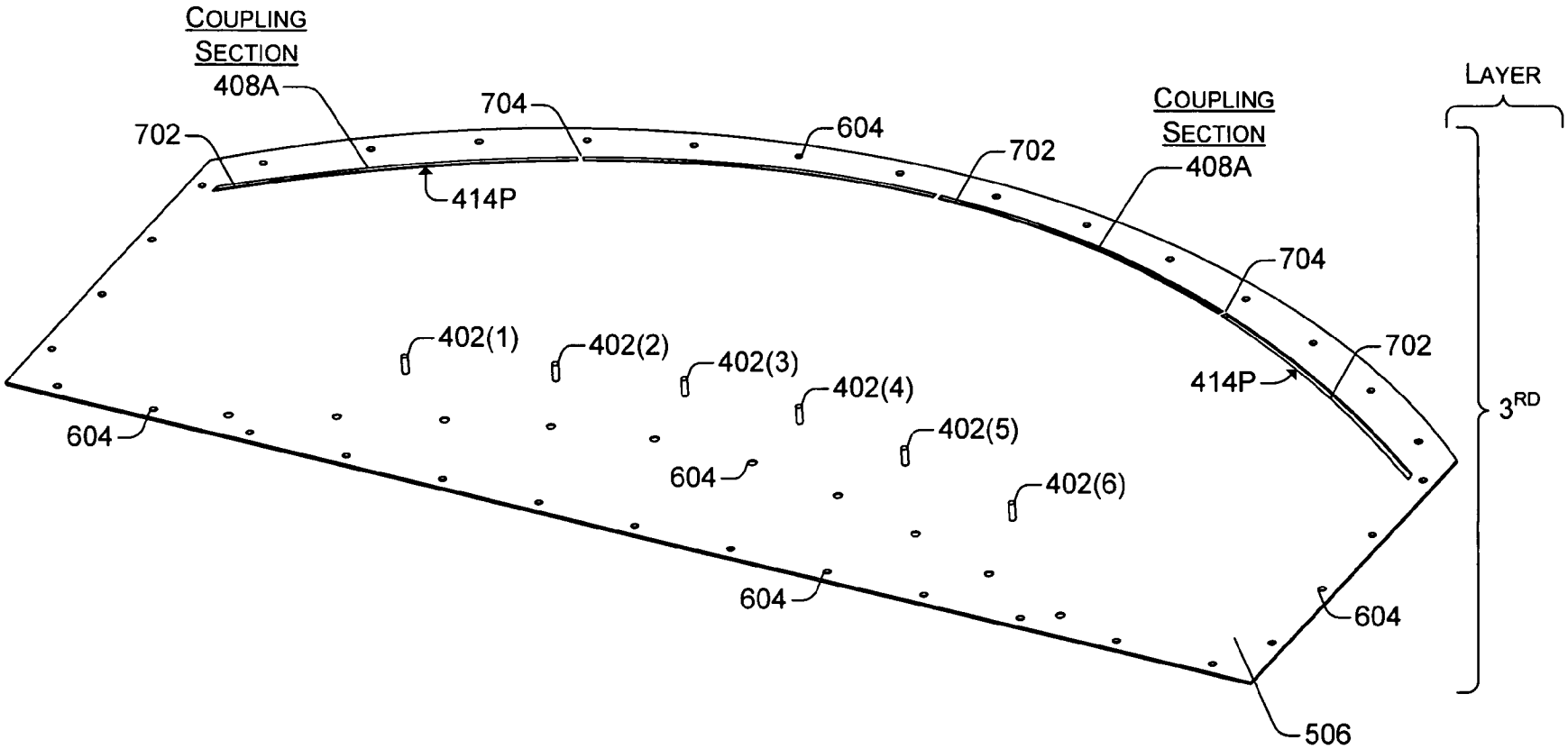
FIG. 7 is a partial exploded view of the exemplary implementation of the electromagnetic lens of FIG. 5 that illustrates the third layer thereof.

FIG. 7 is a partial exploded view of the exemplary implementation of the electromagnetic lens 210 of FIG. 5 that illustrates the third layer thereof. Common plate 506 is shown so as to further reveal coupling section 408A and the locations of input probes 402(1 . . . 6). The parabolic shape of coupling wall 414P (from input spacer 504 (not shown in FIG. 7)) is apparent from a coupling slot 702, which is also in a parabolic shape. Coupling slot 702 enables the electromagnetic wave to be coupled from input section 406A to output section 410A (of FIG. 8).

Coupling slot 702 may be one continuous gap or opening. However, coupling slot 702 is illustrated as including optional bridges 704. One or more bridges 704 serve to mechanically reinforce coupling slot 702 and therefore also common plate 506. Three bridges 704 are shown in FIG. 7. Although the illustrated bridges 704 are approximately rectangular, they may be formed from other shapes in alternative implementations. Regardless, bridges 704 extend across the gap of coupling slot 702 and can reduce physical flexing (i.e., increase the mechanical stability) of common plate 506. Bridges 704 may be made negligibly small such that they do not usually affect electromagnetic wave characteristics or propagation to a noticeable or at least a relevant degree.

FIG. 8 is a partial exploded view of the exemplary implementation of the electromagnetic lens 210 of FIG. 5 that illustrates the third, fourth, and fifth layers thereof. The partial exploded view of FIG. 8 is flipped over "bottom side up" to better illustrate details that are hidden in the exploded view of FIG. 5. Output spacer 508 of the fourth layer and common plate 506 of the third layer are shown in contact with each other. Output plate 510 of the fifth layer is shown separated from output spacer 508 (and common plate 506) to reveal output section 410A and coupling section 408A. The parabolic shape of (output) coupling wall 414P and the linear shape of output reflector 416L are visible, too.

In a described implementation, eight output probes 404(1), 404(2), 404(3), 404(4), 404(5), 404(6), 404(7), and 404(8) are utilized. These eight output probes 404(1 . . . 8) correspond to eight antenna elements of antenna array 208, and they are coupled thereto. To couple the eight output probes 404(1 . . . 8) to antenna array 208, the eight output probes 404(1 . . . 8) are exposed through eight orifices 802(1), 802(2), 802(3), 802(4), 802(5), 802(6), 802(7), and 802(8), respectively. To avoid electromagnetic signal interaction, the eight output probes 404(1 . . . 8) are insulated from output plate 510 (e.g., with air or another non-conductor).

Output plate 510, output spacer 508, and common plate 506 (see FIG. 7, too) are shown with a multitude of holes, many of which are specifically indicated as holes 604. The holes are used to fasten at least output plate 510, output spacer 508, and common plate 506 together using rivets, screws, bolts, and so forth. However, alternative fastening mechanism(s) may be used to fasten output plate 510, output spacer 508, and common plate 506 together.

Figure 9:
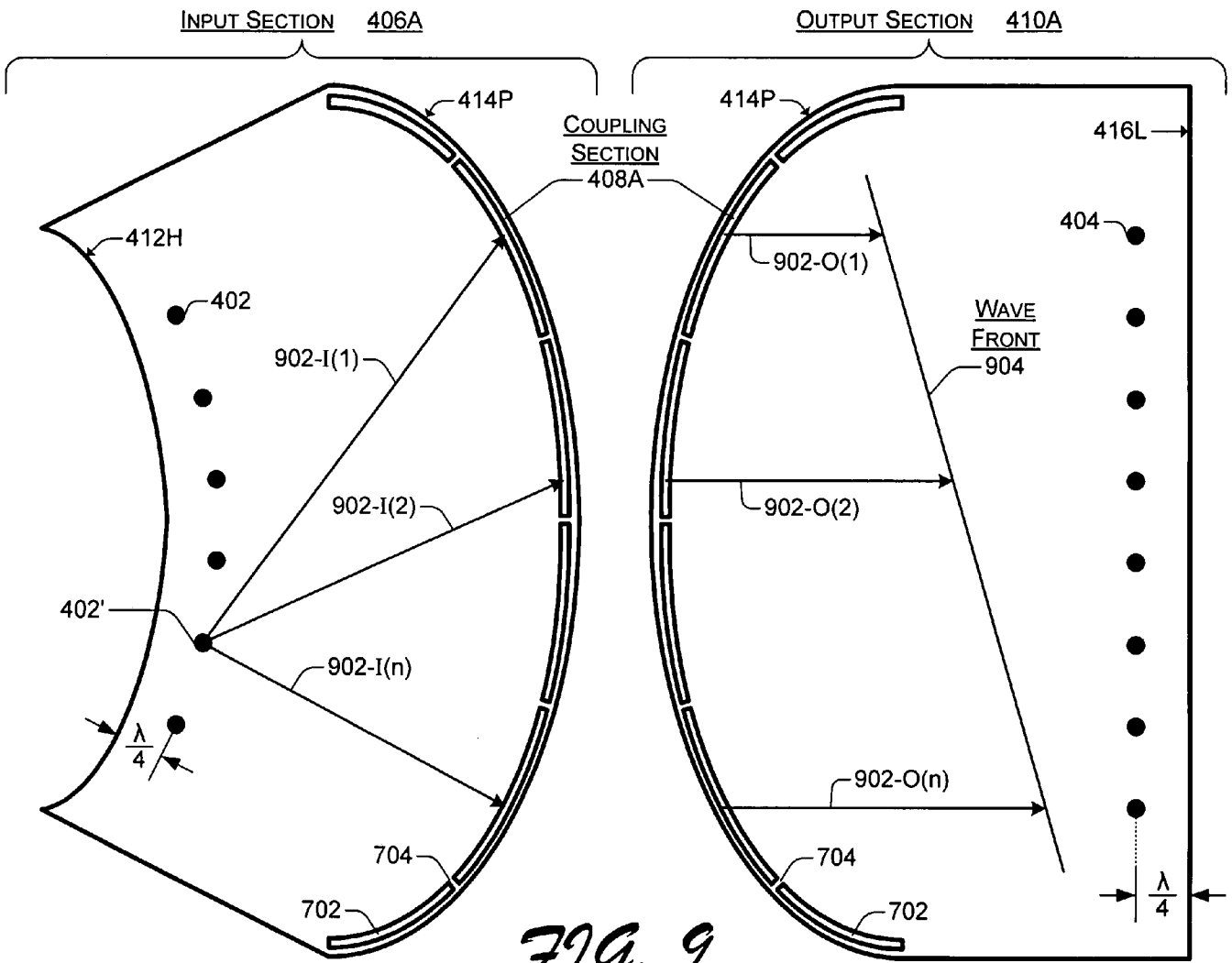
FIG. 9 illustrates an input section and an output section of the exemplary implementation of the electromagnetic lens of FIG. 5 along with an electromagnetic wave propagating therein.

FIG. 9 illustrates an input section 406A and an output section 410A of the exemplary implementation of the electromagnetic lens 210 of FIG. 5 along with an electromagnetic wave propagating therein. Exemplary individual rays 902 of the propagating electromagnetic wave are shown. Input section 406A is illustrated top side up, but output section 410A is illustrated bottom side up. In other words, output section 410A is "unfolded" from under input section 406A and rotated 180° about an axis defined by a central tangent to coupling slot 702 in order to improve clarity. Coupling section 408A is also illustrated.

Input section 406A includes hyperbolic input reflector 412H and six input probes 402. Input probes 402 are located a quarter wavelength ($\lambda/4$) away from the tangent to the hyperbolic shape defined by input reflector 412H and lying along the normal to the tangent. The six input probes 402 are separated along this parabolic contour with spacing that is dependent on the geometric aspects of the hyperbolic shape of input reflector 412H and the parabolic shape defined by coupling wall 414P of coupling section 408A. The six input probes 402 are placed symmetrically about the axis of hyperbolic input reflector 412H. The number of input probes 402 may vary according to the desired number of communication beams 202 used for sector coverage.

As more clearly shown in FIGS. 5–8, common plate 506 separates input section 406A from output section 410A. FIG. 9 may be considered an illustration of both sides of common plate 506 to the extent that common plate 506 forms (at least partially) input section 406A, coupling section 408A, and output section 410A and thus to the extent that it contributes to the guiding of the electromagnetic wave. In an illustrated and described implementation, parts of common plate 506 are covered by input spacer 504 and output spacer 508; therefore, these covered parts do not directly contribute to the guiding of the electromagnetic wave.

Common plate 506, at coupling section 408A, includes coupling slot 702 that mirrors the parabolic shape of coupling wall 414P. Thus, coupling slot 702 also has a parabolic shape in this implementation. Coupling slot 702 includes five bridges 704 for stability. Although three bridges 704 are shown in FIG. 7 and five bridges 704 are shown in FIG. 9, any number of bridges 704 (including zero bridges) may alternatively be implemented, especially if the slot length formed by the bridges are greater than one-half wavelength ($\lambda/2$). Continuing with the output side of common plate 506, coupling section 408A includes coupling slot 702 and coupling wall 414P, both of which are parabolic in shape.

Output section 410A includes eight output probes 404 and output reflector 416L, which has a linear shape. Output probes 404 are located a quarter wavelength ($\lambda/4$) from output reflector 416L. Output probes 404 are proximate to output reflector 416L as compared to (output) coupling wall 414P, and input probes 402 are proximate to input reflector 412H as compared to (input) coupling wall 414P. In this context, proximate implies that the input/output probes 402/404 are closer to one barrier (e.g., input/output reflectors 412H/416L) than another barrier (e.g., coupling wall 414P).

The parabolic shape of coupling wall 414P and coupling slot 702 is capable of collimating the electromagnetic wave so as to cause rays 902 to be parallel and to present a linear phase wave front 904. Specifically, exemplary rays 902-I(1), 902-I(2) . . . 902-I(*n*) in input section 406A are shown launching from a single input probe 402'. The distance that ray 902-I(*n*) traverses from the emanating input probe 402' to coupling slot 702 is shorter than the distance that ray 902-I(2) traverses from the emanating input probe 402' to coupling slot 702. Furthermore, the distance that ray 902-I(2) traverses from the emanating input probe 402' to coupling slot 702 is shorter than the distance that ray 902-I(1) traverses from the emanating input probe 402' to coupling slot 702.

As a result of the differing distances traversed by rays 902, ray 902-I(*n*) arrives at coupling slot 702 prior to when ray 902-I(2) arrives thereat, and ray 902-I(2) arrives at coupling slot 702 prior to when ray 902-I(1) arrives thereat. Consequently, ray 902-I(1) is time delayed with respect to ray 902-I(2), and ray 902-I(2) is time delayed with respect to ray 902-I(*n*). These time delays correspond to phase variations at coupling section 408A.

Coupling section 408A, via coupling slot 702 and parabolic coupling wall 414P, couples rays 902 from input section 406A to output section 410A. The parabolic shape of (input and output) coupling wall 414, along with coupling slot 702, causes the propagating rays 902-I from input section 406A to be collimated as they are coupled via coupling section 408A to output section 410A as rays 902-O. Hence, rays 902-O(1), 902-O(2) . . . 902-O(n) are parallel to each other. It should be understood that rays 902-O are likely not exactly parallel; however, rays 902-O are sufficiently parallel so as to create a substantially-linear phase relationship for wave front 904.

Wave front 904, and rays 902-O(1), 902-O(2) . . . 902-O(n) thereof, propagate toward and reach output probes 404 (possibly via linear output reflector 416L). Each ray 902-O has a different phase shift. Consequently, each output probe 404 receives a ray 902-O having a different phase shift. The signals output from output probes 404 can therefore already have appropriate phase shifts for forwarding to antenna array 208 to produce directional communication beams 202.

In order to minimize or eliminate additional phase adjustment after the output of electromagnetic lens 210, output rays 902-O of wave front 904 of the electromagnetic wave presents a linear phase relationship to output probes 404. This linear phase front establishes varying phase shifts for the electromagnetic signal, which emanated from input probe 402', at output probes 404 using the folded parallel plate waveguide lens. The established varying phase shifts are appropriate for correct production of communication beams 202 by the antenna elements of antenna array 208.

Figure 10:
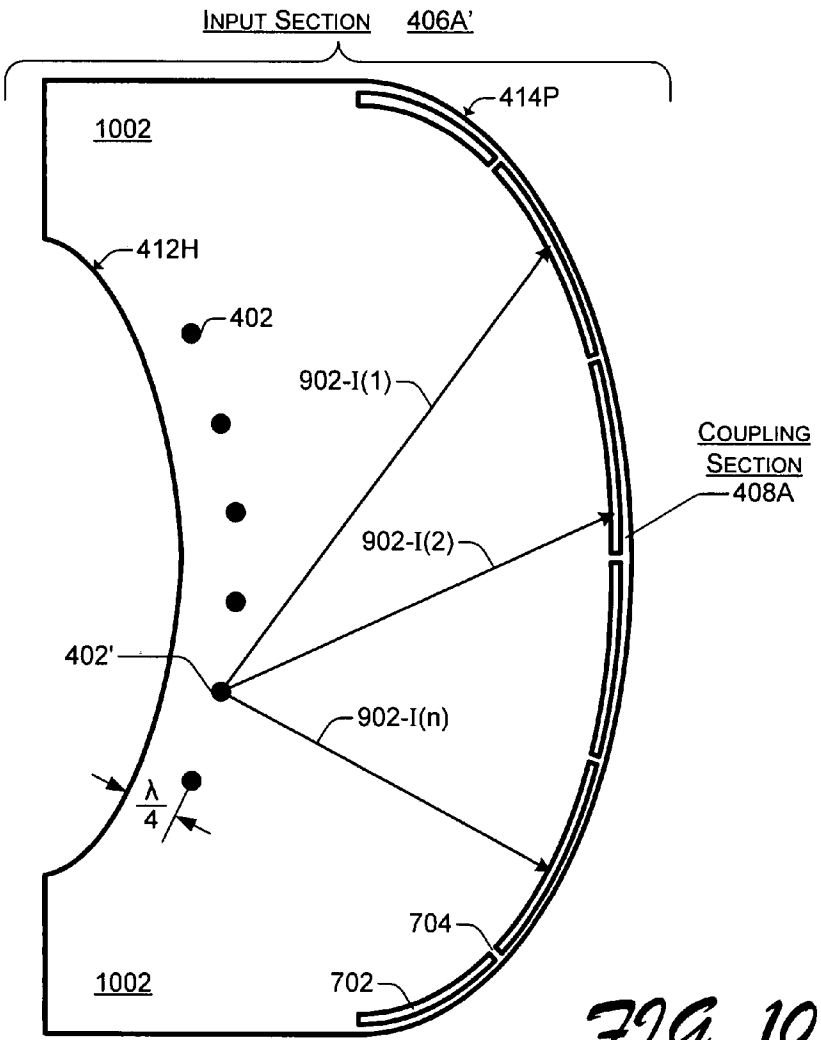
FIG. 10 illustrates an alternative input section for the exemplary implementation of the electromagnetic lens of FIGS. 5 and 9 along with an electromagnetic wave propagating therein.

FIG. 10 illustrates an alternative input section 406A' for the exemplary implementation of the electromagnetic lens 210 of FIGS. 5 and 9 along with an electromagnetic wave propagating therein. Regions 1002 indicate areas of difference between input section 406A and input section 406A'. Specifically, an additional waveguide area with a right-angle corner is part of input section 406A'.

This additional area does precipitate multi-bounce(s) and concomitant side-lobe degeneration, especially for those signals associated with input probes 402 that are closest to regions 1002. However, input section 406A' represents one example of an alternative configuration for input section 406A (and thus output section 410A similarly). In other words, and by way of example only, the side walls of input section 406A (and output section 410A) are not necessarily parallel to the direction of propagation of the electromagnetic wave that is of primary interest. Other wall, angle, spacing, etc. alternatives may also be implemented.

Figure 11:
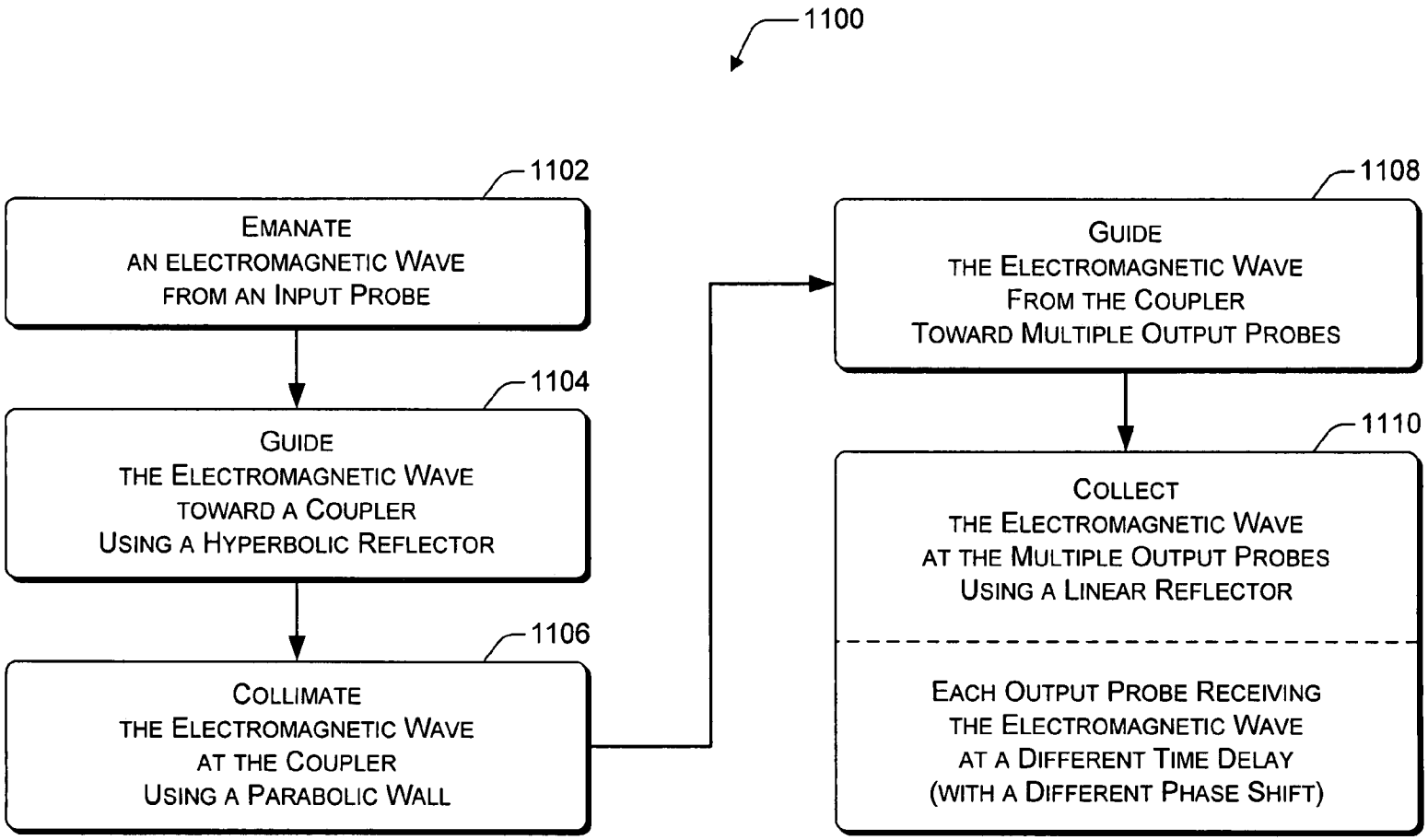
FIG. 11 is a flow diagram that illustrates an exemplary method for utilizing an electromagnetic lens such as the exemplary implementation of FIGS. 5 and 9.

FIG. 11 is a flow diagram 1100 that illustrates an exemplary method for utilizing an electromagnetic lens such as the exemplary implementation of FIGS. 5 and 9. Flow diagram 1100 includes five (5) blocks 1102–1110. The actions of flow diagram 1100 may be performed, for example, by an electromagnetic lens (e.g., an electromagnetic lens 210 of FIGS. 2, 4A, 4B, 5–8, 9, etc.), and exemplary explanations of these actions are provided with reference thereto.

At block 1102, an electromagnetic wave is emanated from an input probe. For example, an electromagnetic wave having rays 902-I may be launched from input probe 402' within input section 406A. It should be understood that different electromagnetic wave signals may be (at least approximately) simultaneously launched from different input probes 402 and propagated through electromagnetic lens 210 for simultaneous reception at multiple output probes 404.

At block 1104, the electromagnetic wave is guided toward a coupler using a hyperbolic reflector. For example, parallel input and common plates 502 and 506 may guide rays 902-I toward coupling slot 702 of coupling section 408A using hyperbolic-shaped input reflector 412H.

At block 1106, the electromagnetic wave is collimated at the coupler using a parabolic wall. For example, rays 902-I may be collimated by parabolic-shaped coupling wall 414P of coupling section 408A such that rays 902 of the electromagnetic wave become substantially parallel to each other. Rays 902-I may also be directed/redirected from input section 406A to output section 410A as rays 902-O via coupling slot 702.

At block 1108, the electromagnetic wave is guided from the coupler toward multiple output probes. For example, parallel common and output plates 506 and 510 may guide rays 902-O from coupling slot 702 toward output probes 404 using coupling wall 414P.

At block 1110, the electromagnetic wave is collected at the multiple output probes using a linear reflector. For example, rays 902-O may be received at output probes 404 using linear-shaped output reflector 416L. It should be understood that at least a portion of the electromagnetic wave may be collected by output probes 404 before any reflection(s).

Each output probe receives the electromagnetic wave at a different time delay and therefore with a different phase shift. For example, the electromagnetic wave having a linear phase wave front 904 may impact output probes 404 at an angle (e.g., with a normal of wave front 904 that is not perpendicular to output reflector 416L or to a line on which output probes 404 lie) such that each output probe 404 receives an electromagnetic signal having a different time delay/phase shift.

The electromagnetic wave signals may thereafter be forwarded from electromagnetic lens 210 and/or directly provided to antenna array 208 for creation of communication beams 202. The above description with reference to FIG. 11 pertains to a transmission mode for an access station 102. However, electromagnetic lens 210 may also be utilized in a reception mode in which electromagnetic signals received via communication beams 202 are input to electromagnetic lens 210 from antenna array 208. Eight probes 404(1 . . . 8) input the electromagnetic signals into electromagnetic lens 210, and one or more of the six probes 402(1 . . . 6) output/forward received signals toward signal processors 212.

With particular reference to FIGS. 4B, 5, 9, and 11, two reflectors and at least one coupling wall are addressed below. Specifically, input reflector 412, coupling wall 414, and output reflector 416 are illustrated and/or referenced. Coupling wall 414 in certain implementations may be considered as having an input coupling wall 414I part and an output coupling wall 414O part.

With an implementation described above with reference to FIGS. 5–11, input reflector 412 comprises a hyperbolic input reflector 412H, coupling wall 414 comprises a parabolic coupling wall 414P, and output reflector 416 comprises a linear output reflector 416L. Although hyperbolic input reflector 412H is illustrated as being convex, it may alternatively be concave, with concave and convex being determined from the perspective of the relevant waveguide section and the location of input/output probes 402/404.

More generally, input reflector 412 may comprise at least a portion of any non-circular conic. Non-circular conics include parabolas, hyperbolas, and ellipses. Although coupling wall 414 is concave to facilitate collimation, and output reflector 416 is linear as illustrated, the non-circular conics for input reflector 412 may be concave or convex.

In other implementation(s), input reflector 412, coupling wall 414, and output reflector 416 may comprise any curvilinear shape. A (convex or concave) curvilinear section as used herein may be a non-circular conic section, a linear section, or an extrapolated curve section with multiple foci or with a relationship thereto. In such an extrapolated curve implementation, input reflector 412 comprises a multi-foci extrapolated curve (MFEC), coupling wall 414 comprises a linear section, and output reflector 416 comprises a curve that is related to the MFEC such that a linear phase relationship for guided electromagnetic waves is established in the vicinity of (including at) output probes 404. An exemplary extrapolated curve implementation is described further below with reference to FIGS. 12 and 13.

Figure 12:
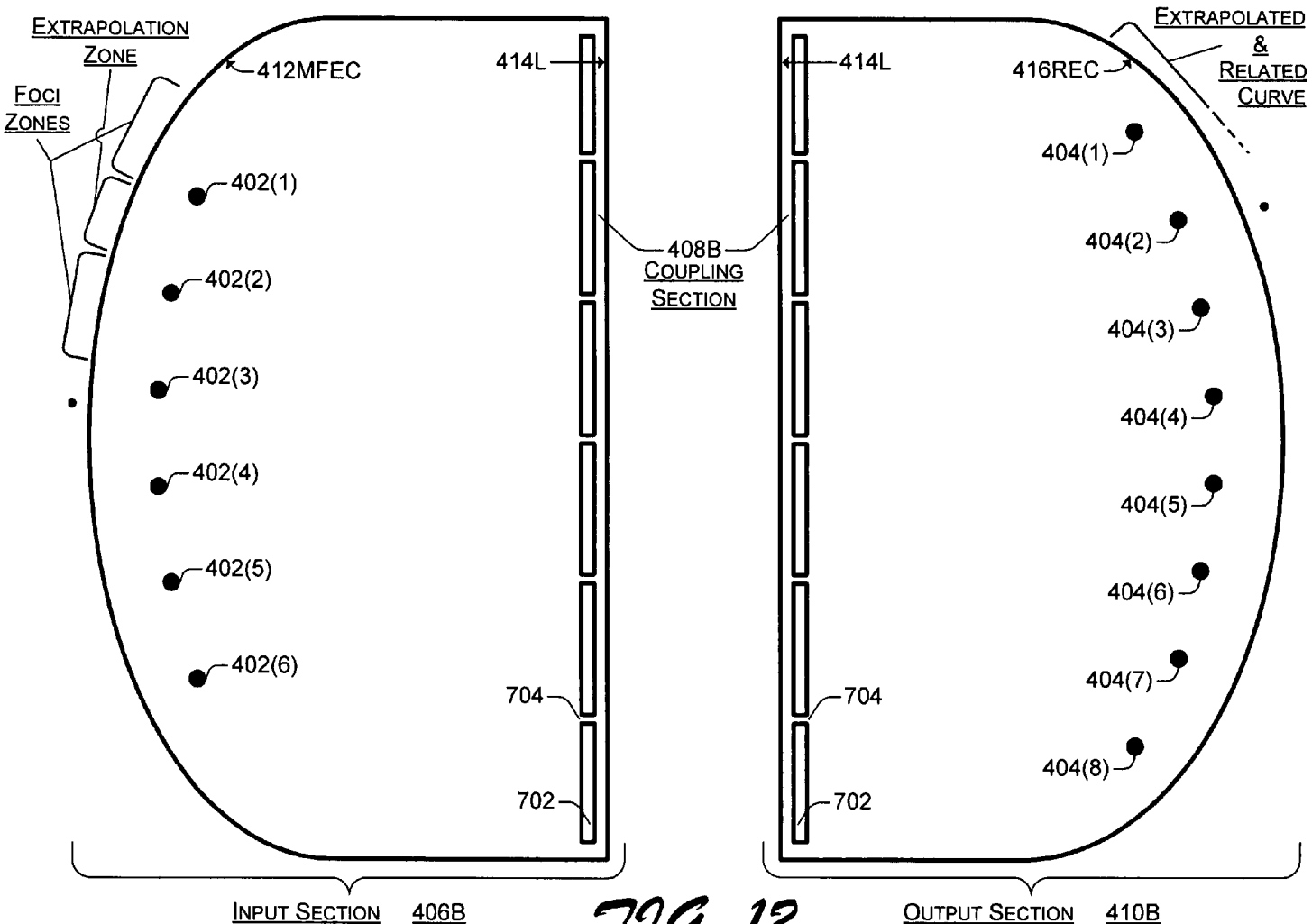
FIG. 12 illustrates an input section and an output section for an alternative exemplary implementation of an electromagnetic lens that has extrapolated curves.

FIG. 12 illustrates an input section 406B and an output section 410B for an alternative exemplary implementation of an electromagnetic lens 210 that has extrapolated curves. A coupling section 408B is also illustrated. Input section 406B includes six input probes 402(1 . . . 6) and an input reflector 412MFEC having a multi-foci extrapolative curve (MFEC) shape. Coupling section 408B includes a coupling slot 702 and a coupling wall 414L, both of which have linear shapes. Output section 410B includes eight output probes 404(1 . . . 8) and an output reflector 416REC having a related extrapolated curve (REC) shape.

The MFEC shape of input reflector 412MFEC may be designed/determined as follows. First, a number of so-called perfect foci are selected. For example, three, four, or five foci are selected for inclusion in the MFEC shape. Second, for each selected focus, a curve (e.g., a parabolic curve) is created to establish the selected focus. This is indicated as the foci zones along input reflector 412MFEC. Third, an overall curve is created by extrapolating between the foci zones. This is indicated as extrapolation zone(s) along input reflector 412MFEC. Fourth, input probes 402(1 . . . 6) are then placed in the vicinity of one or more of the selected foci and located approximately a quarter wavelength ($\lambda/4$) from the surface of input reflector 412MFEC.

The REC shape of output reflector 416REC is designed/determined in dependence upon the MFEC shape of input reflector 412MFEC. Specifically, the REC shape is adapted so that a linear phase front is presented for output probes 404 after the electromagnetic wave reflects from output reflector 416REC. A curvature that is capable of establishing a linear phase relationship for rays propagating toward output probes 404 may be ascertained, for example, by ray tracing analysis or by using an electromagnetic 3D modeler. An example of a suitable electromagnetic 3D modeler is the Ansoft High Frequency Structure Simulator (HFSS).

There is therefore a relationship between the MFEC shape of input reflector 412MFEC and the REC shape of output reflector 416REC. In other words, given that input probes 402 launch an electromagnetic wave and are located in the vicinity of at least one focus of the multiple foci of input reflector 412MFEC, the curvature of output reflector 416REC is adapted to cause a linear phase relationship at output probes 404 for the electromagnetic wave that has been coupled by coupling section 408B from input section 406B into output section 410B and directed toward output probes 404 as well as output reflector 416REC using coupling slot 702 and coupling wall 414L.

Figure 13:
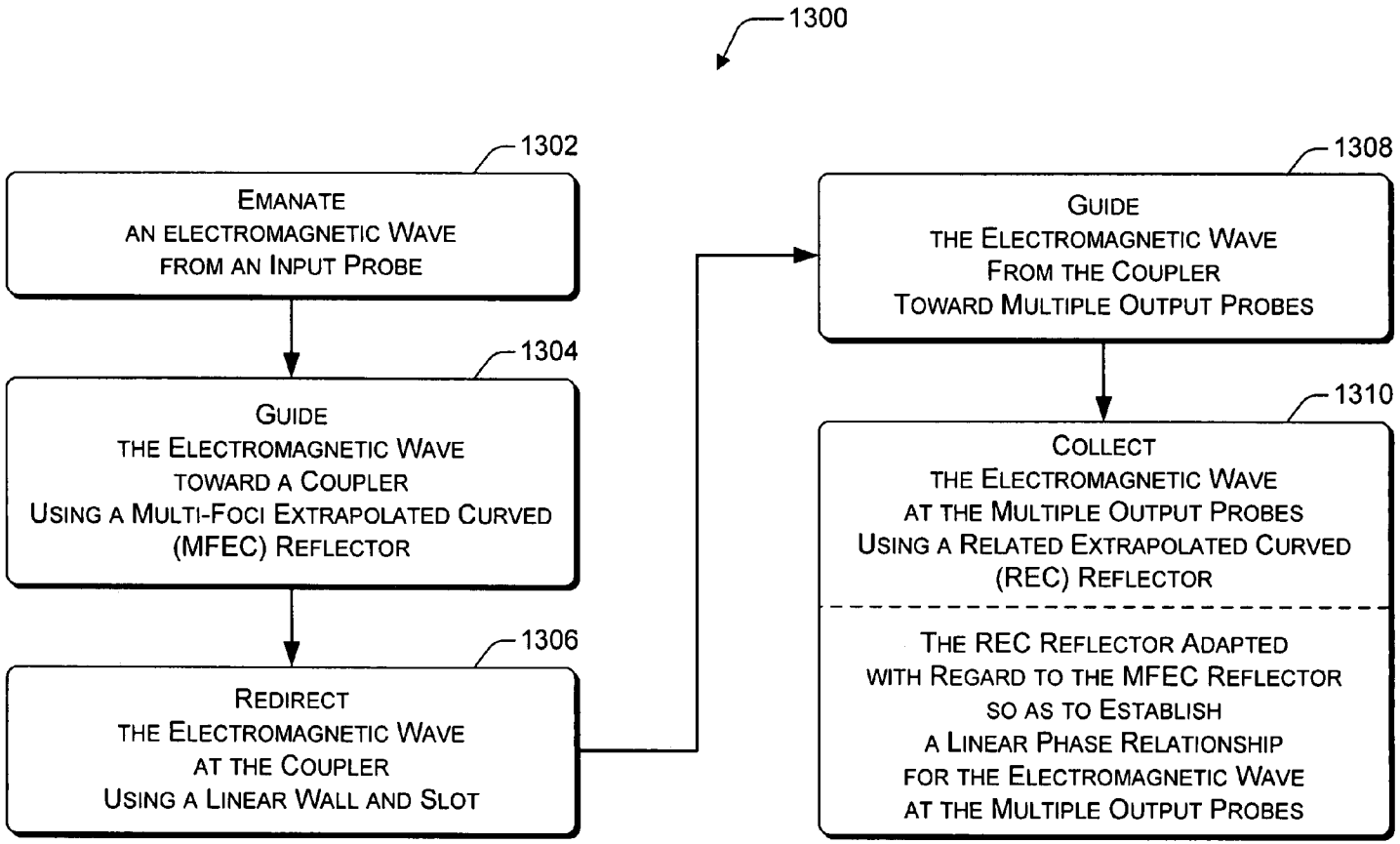
FIG. 13 is a flow diagram that illustrates an exemplary method for utilizing an electromagnetic lens such as the exemplary implementation of FIG. 12.

FIG. 13 is a flow diagram 1300 that illustrates an exemplary method for utilizing an electromagnetic lens such as the exemplary implementation of FIG. 12. Flow diagram 1300 includes five (5) blocks 1302–1310. The actions of flow diagram 1300 may be performed, for example, by an electromagnetic lens (e.g., an electromagnetic lens 210 of FIGS. 2, 4A, 4B, 12, etc.), and exemplary explanations of these actions are provided with reference thereto.

At block 1302, an electromagnetic wave is emanated from an input probe. For example, individual electromagnetic waves may be launched from individual respective input probes 402 of one or more of input probes 402(1 . . . 6) within input section 406B.

At block 1304, the electromagnetic wave is guided toward a coupler using an MFEC reflector. For example, parallel input and common plates 502 and 506 (see FIG. 5) of first and third layers of electromagnetic lens 210 may guide an individual electromagnetic wave toward coupling slot 702 (and therefore coupling wall 414L) of coupling section 408B using MFEC-shaped input reflector 412MFEC of input spacer 504 of a second layer of electromagnetic lens 210.

At block 1306, the electromagnetic wave is redirected at the coupler using a linear wall and slot. For example, the individual electromagnetic wave may be redirected by linear-shaped coupling wall 414L (also of input spacer 504 of the second layer of electromagnetic lens 210) and linear-shaped coupling slot 702 of coupling section 408B such that the individual electromagnetic wave may be coupled from input section 406B to output section 410B.

At block 1308, the electromagnetic wave is guided from the coupler toward multiple output probes. For example, parallel common and output plates 506 and 510 of third and fifth layers of electromagnetic wave 210 may guide the individual electromagnetic wave from coupling slot 702 toward output probes 404 using coupling wall 414L of output spacer 508 of a fourth layer of electromagnetic lens 210.

At block 1310, the electromagnetic wave is collected at the multiple output probes using an REC reflector. For example, the individual electromagnetic wave may be received at output probes 404(1 . . . 8) using REC-shaped output reflector 416REC (also of output spacer 508 of the fourth layer of electromagnetic lens 210). Each output probe 404 receives the individual electromagnetic wave at a different time delay and therefore with a different phase shift.

The REC reflector is adapted with regard to the MFEC reflector so as to establish a linear phase relationship for the electromagnetic wave at the multiple output probes. For example, output reflector 416REC is adapted with regard to input reflector 412MFEC so as to establish a linear phase relationship for each of the individual electromagnetic waves, which were launched from respective individual input probes 402(1 . . . 6), at output probes 404(1 . . . 8). It should be noted that a phase relationship may be considered linear if it is sufficiently close to linear such that communication beams 202 of a desired quality (e.g., with respect to shape, length, width, power, etc.) are produced from an associated antenna array 208.

Portions of the diagrams of FIGS. 1–13 are illustrated as blocks, curves, structures, etc. that represent features, shapes, devices, logic, components, functions, actions, some combination thereof, and so forth. However, the order, layout, and/or interconnections in which the diagrams are described and/or shown is not intended to be construed as a limitation, and any number of the blocks, curves, structures, etc. (or parts thereof) can be combined, augmented, omitted, extrapolated, truncated, and/or re-arranged in any manner to implement one or more methods, systems, apparatuses (including electromagnetic lenses, access stations, etc.), arrangements, schemes, approaches, etc. for electromagnetic lenses (including uses thereof).

Although methods, systems, apparatuses (including electromagnetic lenses, access stations, etc.), arrangements, schemes, approaches, and other implementations have been described in language specific to structural and functional features and/or flow diagrams, it is to be understood that the invention defined in the appended claims is not necessarily limited to the specific features or flow diagrams described. Rather, the specific features and flow diagrams are disclosed as exemplary forms of implementing the claimed invention.

What is claimed is:

1. An electromagnetic lens comprising:

an input section including a plurality of input probes and a curvilinear input reflector;

an output section including a plurality of output probes and a curvilinear output reflector; and a coupling section including a coupling slot and a curvilinear coupling wall.

2. The electromagnetic lens as recited in claim 1, wherein the curvilinear input reflector comprises a non-circular conic section, the curvilinear output reflector comprises a linear section, and the curvilinear coupling wall comprises a parabolic section.

3. The electromagnetic lens as recited in claim 2, wherein the parabolic section of the curvilinear coupling wall is concave.

4. The electromagnetic lens as recited in claim 2, wherein the coupling slot comprises a parabolic section.

5. The electromagnetic lens as recited in claim 2, wherein the non-circular conic section of the curvilinear input reflector comprises at least one of a hyperbolic section, an elliptical section, and a parabolic section.

6. The electromagnetic lens as recited in claim 5, wherein the non-circular conic section is at least one of convex and concave.

7. The electromagnetic lens as recited in claim 1, wherein the curvilinear input reflector comprises a multi-foci extrapolated curved section, the curvilinear output reflector comprises an extrapolated curve section that is related to the multi-foci extrapolated curved section of the curvilinear input reflector, and the curvilinear coupling wall comprises a linear section.

8. The electromagnetic lens as recited in claim 7, wherein the coupling slot comprises a linear section.

9. The electromagnetic lens as recited in claim 7, wherein the extrapolated curve section of the curvilinear output reflector is related to the multi-foci extrapolated curved section of the curvilinear input reflector such that an electromagnetic wave emanating from at least one input probe of the plurality of input probes that is reflected from the curvilinear input reflector and directed through the coupling slot via the curvilinear coupling wall presents a linear phase front at the plurality of output probes after reflection from the curvilinear output reflector.

10. The electromagnetic lens as recited in claim 7, wherein the multi-foci extrapolated curved section provides a plurality of foci via a plurality of foci zones that are interconnected via a plurality of extrapolation zones.

11. The electromagnetic lens as recited in claim 10, wherein the plurality of foci comprises three, four, or five foci.

12. The electromagnetic lens as recited in claim 1, wherein the input section is formed, at least partially, from an input plate and a common plate that are substantially parallel to each other.

13. The electromagnetic lens as recited in claim 12, wherein the input section is also formed from at least part of an input spacer, the input spacer establishing the curvilinear input reflector.

14. The electromagnetic lens as recited in claim 1, wherein the output section is formed, at least partially, from a common plate and an output plate that are substantially parallel to each other.

15. The electromagnetic lens as recited in claim 14, wherein the output section is also formed from at least part of an output spacer, the output spacer establishing the curvilinear output reflector.

16. The electromagnetic lens as recited in claim 1, wherein the coupling slot comprises a gap and includes at least one bridge that extends across the gap for mechanical stability of the electromagnetic lens.

17. The electromagnetic lens as recited in claim 1, wherein the coupling slot enables electromagnetic waves to be coupled from the input section to the output section.

18. The electromagnetic lens as recited in claim 1, wherein the electromagnetic lens is configured so that: an electromagnetic wave emanating from at least one input probe of the plurality of input probes is guided along the input section to the coupling section, the electromagnetic wave is directed from the input section through the coupling slot to the output section, and the electromagnetic wave is guided along the output section to the plurality of output probes.

19. The electromagnetic lens as recited in claim 18, wherein the electromagnetic lens is further configured such that: the electromagnetic wave is guided along the input section from the plurality of input probes using the curvilinear input reflector, the electromagnetic wave is coupled from the input section to the output section via the coupling slot using the curvilinear coupling wall of the coupling section, and the electromagnetic wave is guided along the output section to the plurality of output probes using the curvilinear output reflector.

20. The electromagnetic lens as recited in claim 1, wherein the plurality of input probes comprises six input probes.

21. The electromagnetic lens as recited in claim 1, wherein the plurality of output probes comprises eight output probes.

22. The electromagnetic lens as recited in claim 1, wherein the plurality of input probes are proximate to the curvilinear input reflector, and the plurality of output probes are proximate to the curvilinear output reflector.

23. The electromagnetic lens as recited in claim 1, wherein the input section, the output section, and the coupling section comprise at least one electromagnetic medium.

24. The electromagnetic lens as recited in claim 23, wherein the at least one electromagnetic medium comprises air.

25. The electromagnetic lens as recited in claim 23, wherein the at least one electromagnetic medium comprises a non-air dielectric.

26. An access station comprising:

a lens including:

an input section including a plurality of input probes and a curvilinear input reflector;

an output section including a plurality of output probes and a curvilinear output reflector; and a coupling section including a coupling slot and a curvilinear coupling wall.

27. The access station as recited in claim 26, further comprising:

an antenna array that is coupled to the plurality of output probes.

28. The access station as recited in claim 27, wherein the antenna array includes a plurality of antenna elements; and wherein each respective antenna element of the plurality of antenna elements is coupled to a respective output probe of the plurality of output probes.

29. The access station as recited in claim 28, wherein the plurality of antenna elements and the plurality of output probes both number eight.

30. The access station as recited in claim 26, further comprising:

one or more signal processors that are coupled to the plurality of input probes.

31. The access station as recited in claim 30, wherein the one or more signal processors include a plurality of processor interfaces; and wherein each respective processor interface of the plurality of processor interfaces is coupled to a respective input probe of the plurality of input probes.

32. The access station as recited in claim 31, wherein the plurality of processor interfaces and the plurality of input probes both number six.

33. The access station as recited in claim 26, wherein the access station comprises a Wi-Fi switch.

34. The access station as recited in claim 26, wherein the access station operates in accordance with at least one IEEE 802.11 standard.

35. The access station as recited in claim 26, wherein the curvilinear input reflector comprises a non-circular conic section, the curvilinear output reflector comprises a linear section, and the curvilinear coupling wall comprises a parabolic section.

36. The access station as recited in claim 26, wherein the curvilinear input reflector comprises a multi-foci extrapolated curved section, the curvilinear output reflector comprises an extrapolated curve section that is related to the multi-foci extrapolated curved section of the curvilinear input reflector, and the curvilinear coupling wall comprises a linear section.

37. The access station as recited in claim 26, wherein the lens is configured so that: an electromagnetic wave emanating from at least one input probe of the plurality of input probes is guided along the input section to the coupling section, the electromagnetic wave is directed from the input section through the coupling slot to the output section, and the electromagnetic wave is guided along the output section to the plurality of output probes.

38. The access station as recited in claim 37, wherein the lens is further configured such that: the electromagnetic wave is guided along the input section from the plurality of input probes using the curvilinear input reflector, the electromagnetic wave is coupled from the input section to the output section via the coupling slot using the curvilinear coupling wall of the coupling section, and the electromagnetic wave is guided along the output section to the plurality of output probes using the curvilinear output reflector.

39. An electromagnetic lens comprising:

an input section including a plurality of input probes and a curvilinear input reflector having a non-circular conic section;

an output section including a plurality of output probes and a linear output reflector; and a coupling section including a coupling slot and a curvilinear coupling wall having a parabolic section.

40. The electromagnetic lens as recited in claim 39, wherein the parabolic section of the curvilinear coupling wall is concave and capable of collimating rays of a propagating electromagnetic wave.

41. The electromagnetic lens as recited in claim 39, wherein the coupling slot comprises a parabolic section.

42. The electromagnetic lens as recited in claim 39, wherein the non-circular conic section of the curvilinear input reflector comprises at least one of a hyperbolic section, an elliptical section, and a parabolic section.

43. The electromagnetic lens as recited in claim 42, wherein the non-circular conic section is at least one of convex and concave.

44. The electromagnetic lens as recited in claim 39, wherein the non-circular conic section of the curvilinear input reflector comprises a convex hyperbolic section.

45. An electromagnetic lens comprising:

an input plate;

an output plate;

a common plate having a coupling slot, the common plate located between the input plate and the output plate;

an input spacer having a hyperbolic input reflector and a parabolic input coupling wall, the input spacer located between the input plate and the common plate;

an output spacer having a linear output reflector and a parabolic output coupling wall, the output spacer located between the output plate and the common plate;

at least one input probe located between the input plate and the common plate; and one or more output probes located between the output plate and the common plate.

46. The electromagnetic lens as recited in claim 45, wherein the at least one input probe and the one or more output probes are secured to opposite sides of the common plate.

47. The electromagnetic lens as recited in claim 45, wherein the at least one input probe is located one-quarter wavelength away from the hyperbolic input reflector, and the one or more output probes are located one-quarter wavelength away from the linear output reflector.

48. The electromagnetic lens as recited in claim 45, wherein the hyperbolic input reflector is convex, and the input and output coupling walls are concave.

49. The electromagnetic lens as recited in claim 45, wherein the input spacer is in contact with the input plate and the common plate, and the output spacer is in contact with the output plate and the common plate.

50. The electromagnetic lens as recited in claim 45, wherein the input plate, the input spacer, the common plate, the output spacer, and the output plate are fastened together using at least one of rivets, screws, and bolts.

51. The electromagnetic lens as recited in claim 45, wherein the input plate is substantially parallel to the common plate, and the common plate is substantially parallel to the output plate.

52. The electromagnetic lens as recited in claim 45, wherein the input plate, the input spacer, the common plate, the output spacer, and the output plate are at least one of integrated together and separate from each other.

53. An electromagnetic lens comprising:

a first layer;

a second layer adjacent to the first layer; the second layer including a plurality of input probes, a curvilinear input reflector, and a first curvilinear coupling wall;

a third layer adjacent to the second layer, the third layer including a coupling slot;

a fourth layer adjacent to the third layer; the fourth layer including a plurality of output probes, a curvilinear output reflector, and a second curvilinear coupling wall; and a fifth layer adjacent to the fourth layer.

54. The electromagnetic lens as recited in claim 53, wherein the first layer and the third layer form an electromagnetic waveguide at the second layer; and wherein the third layer and the fifth layer form another electromagnetic waveguide at the fourth layer.

55. The electromagnetic lens as recited in claim 53, wherein the curvilinear input reflector comprises a non-circular conic section, the curvilinear output reflector comprises a linear section, and each of the first and second curvilinear coupling walls comprises a parabolic section.

56. The electromagnetic lens as recited in claim 53, wherein the curvilinear input reflector comprises a multi-foci extrapolated curved section, the curvilinear output reflector comprises an extrapolated curve section that is related to the multi-foci extrapolated curved section of the curvilinear input reflector, and each of the first and second curvilinear coupling walls comprises a linear section.

57. The electromagnetic lens as recited in claim 53, wherein the electromagnetic lens is configured so that: an electromagnetic wave emanating from at least one input probe of the plurality of input probes is guided along the second layer between the first and third layers to the coupling slot, the electromagnetic wave is directed through the coupling slot from the second layer to the fourth layer, and the electromagnetic wave is guided along the fourth layer between the third and fifth layers to the plurality of output probes.

58. The electromagnetic lens as recited in claim 57, wherein the electromagnetic lens is further configured such that: the electromagnetic wave is guided along the second layer from the plurality of input probes using the curvilinear input reflector, the electromagnetic wave is coupled from the second layer to the fourth layer via the coupling slot using the first and second curvilinear coupling walls, and the electromagnetic wave is guided along the fourth layer to the plurality of output probes using the curvilinear output reflector.

59. The electromagnetic lens as recited in claim 57, wherein the electromagnetic lens is further configured such that: the electromagnetic wave is redirected approximately 180° by a combination of the first curvilinear coupling wall, the coupling slot, and the second curvilinear coupling wall.

60. An access station comprising:

a lens including:

a first layer;

a second layer adjacent to the first layer; the second layer including a plurality of input probes, a curvilinear input reflector, and a first curvilinear coupling wall;

a third layer adjacent to the second layer, the third layer including a coupling slot;

a fourth layer adjacent to the third layer; the fourth layer including a plurality of output probes, a curvilinear output reflector, and a second curvilinear coupling wall; and a fifth layer adjacent to the fourth layer.

61. The access station as recited in claim 60, wherein at least one of the first layer, the second layer, the third layer, the fourth layer, and the fifth layer is not integrated with another layer.

62. The access station as recited in claim 60, wherein at least one of the first layer, the second layer, the third layer, the fourth layer, and the fifth layer is integrated with another layer.

63. The access station as recited in claim 60, further comprising:

an antenna array that is coupled to the plurality of output probes and that produces a plurality of communication beams;

wherein a first signal that is applied to a first input probe of the plurality of input probes is produced on a first communication beam of the plurality of communication beams, and a second signal that is applied to a second input probe of the plurality of input probes is produced on a second communication beam of the plurality of communication beams.

64. An electromagnetic lens comprising:

a first layer;

a second layer adjacent to the first layer; the second layer including a plurality of input probes, a hyperbolic input reflector, and a first parabolic coupling wall;

a third layer adjacent to the second layer, the third layer including a parabolic coupling slot;

a fourth layer adjacent to the third layer; the fourth layer including a plurality of output probes, a linear output reflector, and a second parabolic coupling wall; and a fifth layer adjacent to the fourth layer.

65. The electromagnetic lens as recited in claim 64, wherein the first layer is substantially parallel to the third layer, and the third layer is substantially parallel to the fifth layer.

66. The electromagnetic lens as recited in claim 64, wherein the third layer further includes at least one bridge that extends across a gap of the parabolic coupling slot.

67. An electromagnetic lens comprising:

a first layer;

a second layer adjacent to the first layer; the second layer including a plurality of input probes, a multi-foci extrapolated curved reflector, and a first linear coupling wall;

a third layer adjacent to the second layer, the third layer including a linear coupling slot;

a fourth layer adjacent to the third layer; the fourth layer including a plurality of output probes, an extrapolated curved reflector that is related to the multi-foci extrapolated curved reflector, and a second linear coupling wall; and a fifth layer adjacent to the fourth layer.

68. The electromagnetic lens as recited in claim 67, wherein the extrapolated curved reflector is related to the multi-foci extrapolated curved reflector such that an electromagnetic wave (i) that emanates from at least one input probe of the plurality of input probes and (ii) that is reflected from the multi-foci extrapolated curved reflector and redirected through the linear coupling slot via the first and second linear coupling walls presents a linear phase front at the plurality of output probes after reflection from the extrapolated curved reflector.

69. The electromagnetic lens as recited in claim 67, wherein the multi-foci extrapolated curved reflector establishes a plurality of foci via a plurality of foci zones that are interconnected by a plurality of extrapolation zones.

70. The electromagnetic lens as recited in claim 67, wherein the linear coupling slot is proximate to the first and second linear coupling walls.

71. A method for an access station comprising:

emanating an electromagnetic wave from an input probe;

guiding the electromagnetic wave toward a coupler using a hyperbolic reflector;

collimating the electromagnetic wave at the coupler using a parabolic wall;

guiding the electromagnetic wave from the coupler toward a plurality of output probes; and collecting the electromagnetic wave at the plurality of output probes using a linear reflector.

72. A method for an access station comprising:

emanating an electromagnetic wave from an input probe;

guiding the electromagnetic wave toward a coupler using a curvilinear input reflector;

redirecting the electromagnetic wave at the coupler using a curvilinear coupling wall;

guiding the electromagnetic wave from the coupler toward a plurality of output probes; and collecting the electromagnetic wave at the plurality of output probes using a curvilinear output reflector.

73. The method as recited in claim 72, further comprising:

accepting an electromagnetic signal, which corresponds to the electromagnetic wave, at the input probe from a signal processor.

74. The method as recited in claim 72, further comprising:

forwarding the electromagnetic wave or an electromagnetic signal corresponding thereto from the plurality of output probes to an antenna array.

75. The method as recited in claim 74, further comprising:

producing a communication beam from the antenna array, the communication beam carrying the electromagnetic wave or the electromagnetic signal.

76. The method as recited in claim 72, wherein the collecting comprises:

receiving the electromagnetic wave with a different phase at each output probe of the plurality of output probes.

77. The method as recited in claim 76, wherein the receiving comprises:

receiving the electromagnetic wave with a linear phase front at the plurality of output probes.

78. The method as recited in claim 72, wherein the redirecting comprises:

redirecting the electromagnetic wave through a coupling slot at the coupler.

79. The method as recited in claim 72, wherein:

the guiding the electromagnetic wave toward a coupler using a curvilinear input reflector comprises guiding the electromagnetic wave toward the coupler using the curvilinear input reflector that includes a non-circular conic section;

the redirecting the electromagnetic wave at the coupler using a curvilinear coupling wall comprises redirecting the electromagnetic wave at the coupler using the curvilinear coupling wall that includes a parabolic section; and the collecting the electromagnetic wave at the plurality of output probes using a curvilinear output reflector comprises collecting the electromagnetic wave at the plurality of output probes using the curvilinear output reflector that includes a linear section.

80. The method as recited in claim 72, wherein:

the guiding the electromagnetic wave toward a coupler using a curvilinear input reflector comprises guiding the electromagnetic wave toward the coupler using the curvilinear input reflector that includes a multi-foci extrapolated curved section;

the redirecting the electromagnetic wave at the coupler using a curvilinear coupling wall comprises redirecting the electromagnetic wave at the coupler using the curvilinear coupling wall that includes a linear section; and the collecting the electromagnetic wave at the plurality of output probes using a curvilinear output reflector comprises collecting the electromagnetic wave at the plurality of output probes using the curvilinear output reflector that includes an extrapolated curved section that is related to the multi-foci extrapolated curved section of the curvilinear input reflector.

81. A method for an access station comprising:

emanating an electromagnetic wave from an input probe;

guiding the electromagnetic wave toward a coupler using a multi-foci extrapolated curved reflector;

redirecting the electromagnetic wave at the coupler using a linear coupling wall and a coupling slot;

guiding the electromagnetic wave from the coupler toward a plurality of output probes; and collecting the electromagnetic wave at the plurality of output probes using an extrapolated curved reflector that is related to the multi-foci extrapolated curved reflector.

82. The method as recited in claim 81, wherein the collecting comprises:

collecting the electromagnetic wave at the plurality of output probes using the extrapolated curved reflector that is adapted with regard to the multi-foci extrapolated curved reflector so as to establish a linear phase relationship for the electromagnetic wave at the plurality of output probes.

83. An arrangement for an access station comprising:

emanation means for emanating an electromagnetic wave;

collection means for collecting the electromagnetic wave;

first guidance means for guiding the electromagnetic wave from the emanation means toward a curvilinear coupling wall using a curvilinear input reflector;

second guidance means for guiding the electromagnetic wave from the curvilinear coupling wall toward the collection means using a curvilinear output reflector; and coupling means for coupling the electromagnetic wave from the first guidance means to the second guidance means using the curvilinear coupling wall.

84. The arrangement as recited in claim 83, wherein the arrangement is configured such that the electromagnetic wave is collected by the collection means with a plurality of time delays.

85. The arrangement as recited in claim 83, wherein the coupling means for coupling the electromagnetic wave from the first guidance means to the second guidance means using the curvilinear coupling wall is adapted to couple the electromagnetic wave from the first guidance means to the second guidance means via a coupling slot.

* * * * *